US010398932B2

(12) United States Patent
Hamilton et al.

(10) Patent No.: US 10,398,932 B2
(45) Date of Patent: Sep. 3, 2019

(54) TREADMILL INCLUDING A LIFT ASSISTANCE MECHANISM

(71) Applicant: Nautilus, Inc., Vancouver, WA (US)

(72) Inventors: Bryan W. Hamilton, Vancouver, WA (US); Bryce C. Baker, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 15/391,680

(22) Filed: Dec. 27, 2016

(65) Prior Publication Data

US 2017/0189745 A1 Jul. 6, 2017

Related U.S. Application Data

(63) Continuation-in-part of application No. 14/985,516, filed on Dec. 31, 2015.

(51) Int. Cl.

| | |
|---|---|
| ***A63B 22/00*** | (2006.01) |
| ***A63B 22/02*** | (2006.01) |
| *A63B 71/06* | (2006.01) |

(52) U.S. Cl.

CPC ..... *A63B 22/02* (2013.01); *A63B 22/0023* (2013.01); *A63B 71/0619* (2013.01); *A63B 2210/56* (2013.01); *A63B 2225/50* (2013.01)

(58) Field of Classification Search

CPC ..... A63B 22/02

See application file for complete search history.

(56) References Cited

U.S. PATENT DOCUMENTS

| | | | |
|---|---|---|---|
| 3,596,554 | A | 8/1971 | Low et al. |
| 3,826,491 | A | 7/1974 | Elder |
| 4,599,996 | A | 7/1986 | Seith et al. |
| 4,913,396 | A | 4/1990 | Dalebout et al. |
| 4,921,247 | A | 5/1990 | Sterling |
| 5,007,630 | A | 4/1991 | Real et al. |
| 5,085,426 | A | 2/1992 | Wanzer et al. |
| 5,104,119 | A | 4/1992 | Lynch |
| 5,184,988 | A | 2/1993 | Dunham |
| 5,429,563 | A | 7/1995 | Engel et al. |
| 5,513,825 | A | 5/1996 | Gutgsell |
| 5,518,471 | A | 5/1996 | Hettinger et al. |
| 5,662,557 | A | 9/1997 | Watterson et al. |
| 5,669,857 | A | 9/1997 | Watterson et al. |
| 5,672,140 | A | 9/1997 | Watterson et al. |

(Continued)

FOREIGN PATENT DOCUMENTS

TW 408611 B 10/2000

OTHER PUBLICATIONS

NordicTrack C900 User's Manual, NordicTrack, 2010, 36 pages.

(Continued)

*Primary Examiner* — Stephen R Crow

(74) *Attorney, Agent, or Firm* — Dorsey & Whitney LLP

(57) ABSTRACT

A treadmill may include a lift assistance mechanism operative to assist movement of a deck assembly between one or more positions relative to a base frame. A portion of the lift assistance mechanism may translate along a length dimension of the treadmill when inclining the deck assembly. The lift assistance mechanism may assist a user in moving the deck assembly into a storage position and may also assist a deck assembly lift motor in inclining the deck assembly.

22 Claims, 16 Drawing Sheets

(56) References Cited

U.S. PATENT DOCUMENTS 5,674,156 A 10/1997 Watterson et al.
5,674,453 A * 10/1997 Watterson ..... A63B 22/0012 482/54
5,676,624 A 10/1997 Watterson et al.
5,702,325 A 12/1997 Watterson et al.
5,733,228 A * 3/1998 Stevens ..... A63B 22/0023 482/51
5,772,560 A 6/1998 Watterson et al.
5,830,113 A * 11/1998 Coody ..... A63B 22/02 482/54
5,855,537 A * 1/1999 Coody ..... A63B 22/0023 482/51
5,860,893 A 1/1999 Watterson et al.
5,860,894 A 1/1999 Dalebout et al.
5,868,648 A 2/1999 Coody et al.
6,015,368 A 1/2000 Clem et al.
6,095,951 A 8/2000 Skowronski et al.
6,312,363 B1 11/2001 Watterson et al.
6,383,120 B1 5/2002 Lo
6,398,696 B1 6/2002 Tsou
6,461,275 B1 10/2002 Wang et al.
6,471,622 B1 10/2002 Hammer et al.
6,475,121 B2 11/2002 Wang et al.
6,592,496 B1 7/2003 Tsou
6,652,424 B2 11/2003 Dalebout
6,730,002 B2 5/2004 Hald et al.
6,758,791 B1 * 7/2004 Kuo ..... A63B 22/0023 482/54
6,761,667 B1 7/2004 Cutler et al.
6,786,852 B2 9/2004 Watterson et al.
6,830,540 B2 * 12/2004 Watterson ..... A63B 22/0023 482/51
6,843,757 B2 1/2005 Pan et al.
6,857,991 B2 2/2005 Yu
6,884,201 B2 4/2005 Wu
6,913,563 B2 7/2005 Chen
6,916,277 B2 7/2005 Chen
6,926,644 B2 8/2005 Chen
6,974,404 B1 12/2005 Watterson et al.
6,979,283 B2 12/2005 Pan et al.
6,984,193 B2 1/2006 Chen
6,997,852 B2 2/2006 Watterson et al.
7,004,887 B2 2/2006 Pan et al.
7,081,069 B2 7/2006 Hsu
7,104,937 B2 9/2006 Arbuckle et al.
7,179,204 B2 2/2007 Anderson et al.
7,192,388 B2 3/2007 Dalebout
7,211,029 B2 5/2007 Kau
7,285,075 B2 10/2007 Cutler et al.
7,344,481 B2 3/2008 Watterson et al.
7,413,529 B2 8/2008 Lee et al.
7,455,622 B2 11/2008 Watterson et al.
7,455,626 B2 11/2008 Trevino et al.
7,537,549 B2 5/2009 Nelson et al.
7,540,828 B2 6/2009 Watterson et al.
7,544,153 B2 6/2009 Trevino et al.
7,569,000 B2 8/2009 Wang
7,628,730 B1 12/2009 Watterson et al.
7,645,213 B2 1/2010 Watterson et al.
7,717,829 B2 5/2010 Wang
7,722,507 B2 5/2010 Yoo
7,736,280 B2 6/2010 Weier et al.
7,815,550 B2 10/2010 Watterson et al.
7,854,690 B2 12/2010 Trevino et al.
7,862,478 B2 1/2011 Watterson et al.
7,862,483 B2 1/2011 Hendrickson et al.
7,914,421 B2 3/2011 Weier et al.
8,251,874 B2 8/2012 Ashby et al.
8,657,724 B2 2/2014 Yang
8,734,303 B2 5/2014 Huang et al.
8,920,291 B2 12/2014 Chen et al.
9,028,368 B2 5/2015 Ashby et al.
9,039,578 B2 5/2015 Dalebout
9,044,638 B2 6/2015 Huang et al.
9,095,740 B2 8/2015 Wu
9,138,615 B2 9/2015 Olson et al.
9,168,414 B2 10/2015 Liu et al.
9,168,415 B2 10/2015 Liu et al.
9,289,648 B2 3/2016 Watterson
9,586,090 B2 3/2017 Watterson et al.
9,623,281 B2 4/2017 Hendrickson et al.
9,707,441 B2 7/2017 Yang
9,764,184 B2 9/2017 Kueker et al.
9,889,334 B2 2/2018 Ashby et al.
10,188,890 B2 * 1/2019 Olson ..... A63B 21/00192
10,207,148 B2 * 2/2019 Powell ..... A63B 69/0028
2002/0147078 A1 10/2002 Wu
2003/0195088 A1 10/2003 Wang et al.
2004/0138030 A1 7/2004 Wang et al.
2007/0087908 A1 4/2007 Pan et al.
2008/0248935 A1 10/2008 Solow et al.
2013/0190136 A1 7/2013 Watterson
2013/0237381 A1 9/2013 Chen et al.
2013/0267386 A1 10/2013 Her
2018/0099179 A1 4/2018 Chatterton et al.
2018/0117385 A1 5/2018 Watterson et al.
2018/0117419 A1 5/2018 Jackson
2018/0154207 A1 6/2018 Hochstrasser et al.
2018/0154208 A1 6/2018 Powell et al.

OTHER PUBLICATIONS

NordicTrack c200 Treadmill User Manual, ICON Health and Fitness, Inc, 2014, 40 pages.
Nordictrack Power Incline User Manual, 2013, 32 pages.
Spirit Elliptical User Manual, Oct. 1, 2007, 45 pages.

* cited by examiner 136
140
138
138a
138b
140a
140b
142
146
252
254
256
214
216
10
12
202
216a
220
220a
216b
218
224
210
228
230
229
232
234

TREADMILL INCLUDING A LIFT ASSISTANCE MECHANISM

CROSS REFERENCE TO RELATED APPLICATION

This application is a continuation-in-part of U.S. patent application Ser. No. 14/985,516, filed Dec. 31, 2015, and entitled "Treadmill Including a Deck Locking Mechanism", the entire disclosure of which is hereby incorporated by reference herein.

TECHNOLOGICAL FIELD

The present disclosure generally relates to exercise machines, and more particularly, to a treadmill including a lift assistance mechanism.

BACKGROUND

Exercise treadmills generally cover a substantial amount of floor space when in an operating or use configuration. As such, many exercise treadmills include a deck assembly that is pivotally connected to a frame. The deck assembly is positionable between a generally horizontal operating or use position and a generally upright storage position to reduce the amount of floor space taken up by the treadmill when not in use. To move the deck assembly between the generally horizontal operating position and the generally upright storage position, various types of lift assistance mechanisms have been developed and commercialized. Improvements in the field may be desirable for continuing to improve the user's experience.

SUMMARY

In accordance with the present disclosure, a treadmill may include a frame; a deck assembly operably associated with the frame and positionable in an operating position and a storage position; and a lift assistance mechanism supported by the frame at a support location and connected to the deck assembly. The support location may be movable along a length of the treadmill relative to the frame to adjust an angle between the lift assistance mechanism and the deck assembly during movement of the deck assembly.

In some embodiments, the support location is constrained to move in a substantially straight line along the length the treadmill.

In some embodiments, the support location is at least one of rollable or slidable relative to the deck assembly.

In some embodiments, the support location is movable between a first position and a second position along the length of the treadmill when the deck assembly is positioned in the operating position.

In some embodiments, the support location moves from the first position to the second position during inclination of the deck assembly in the operating position.

In some embodiments, the support location is positioned in the first position during movement of the deck assembly between the operating position and the storage position.

In some embodiments, the support location moves along the length of the treadmill during inclination of a front end portion of the deck assembly relative to a rear end portion of the deck assembly.

In some embodiments, the treadmill further includes a track connected to the frame and extending lengthwise along the length of the treadmill; and a mount connected to the lift assistance mechanism at the support location and movable along a length of the track.

In some embodiments, the mount comprises one or more rollers rotatably connected to the lift assistance mechanism at the support location, and the one or more rollers are rollable along the length of the track.

In some embodiments, the mount further includes an axle connected to the lift assistance mechanism at the support location, and the one or more rollers are connected to the axle.

In some embodiments, the one or more rollers include a first roller and a second roller, and the first and second rollers are positioned on opposite sides of lift assistance mechanism at the support location.

In some embodiments, the mount includes a bracket to which the lift assistance mechanism is pivotally connected at the support location, and the bracket is constrained by the track to slide in a substantially straight line along the length of the track.

In some embodiments, the treadmill further includes an incline assembly connected to the deck assembly and supported by the frame; and a link pivotally connected to the lift assistance mechanism and the incline assembly.

In some embodiments, the link has a variable length between its connection to the lift assistance mechanism and the incline assembly.

In some embodiments, the link has a fixed length between its connection to the lift assistance mechanism and the incline assembly.

In some embodiments, the incline assembly includes a lift motor operative to raise a front end portion of the deck assembly relative to a rear end portion of the deck assembly.

In some embodiments, the lift assistance mechanism moves the mount forward relative to the frame when the lift motor raises the front end portion of the deck assembly relative to the rear end portion of the deck assembly to assist the lift motor.

In some embodiments, the lift assistance mechanism is a lift cylinder.

In accordance with the present disclosure, a method of adjusting a deck assembly of a treadmill may include moving the deck assembly from a generally horizontal orientation to an inclined orientation while in an operating position; and while inclining the deck assembly in the operating position, translating a support location of a lift assistance mechanism forwardly along a length of the treadmill.

In some embodiments, the method further includes moving the deck assembly from the operating position to a storage position; and while moving the deck assembly to the storage position, maintaining the support location of the lift assistance mechanism substantially stationary along the length of the treadmill.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

DETAILED DESCRIPTION

The following description of certain exemplary embodiments is merely exemplary in nature and is in no way intended to limit the claimed invention or its applications or uses. In the following detailed description of embodiments of the present disclosure, reference is made to the accompanying drawings which form a part hereof, and in which are shown by way of illustration specific embodiments in which the described assemblies, mechanisms, systems, and methods may be practiced. These embodiments are described in sufficient detail to enable those skilled in the art to practice the presently disclosed assemblies, mechanisms, systems, and methods, and it is to be understood that other embodiments may be utilized and that structural and logical changes may be made without departing from the spirit and scope of the present disclosure. Moreover, for the purpose of clarity, detailed descriptions of certain features will not be discussed when they would be apparent to those with skill in the art so as not to obscure the description of the present assemblies, mechanisms, systems, and methods. The following detailed description is therefore not to be taken in a limiting sense, and the scope of the present assemblies, mechanisms, systems, and methods is defined only by the appended claims.

Embodiments of the present disclosure generally provide a lock mechanism for use with foldable exercise treadmills. As discussed in more detail below, some treadmills are configured with a deck assembly that is pivotally connected with a frame to provide a user the ability to selectively position the treadmill in an operating configuration or a storage configuration. The deck assembly may be locked in the operating configuration, the storage configuration, or both. When locked in the operating configuration, the inclination of the deck assembly may be adjusted during use of the treadmill. Embodiments of the lock mechanism described and depicted herein can be used with various types of exercise treadmills and should not be construed to be limited to use with the treadmill disclosed herein.

Figure 1:
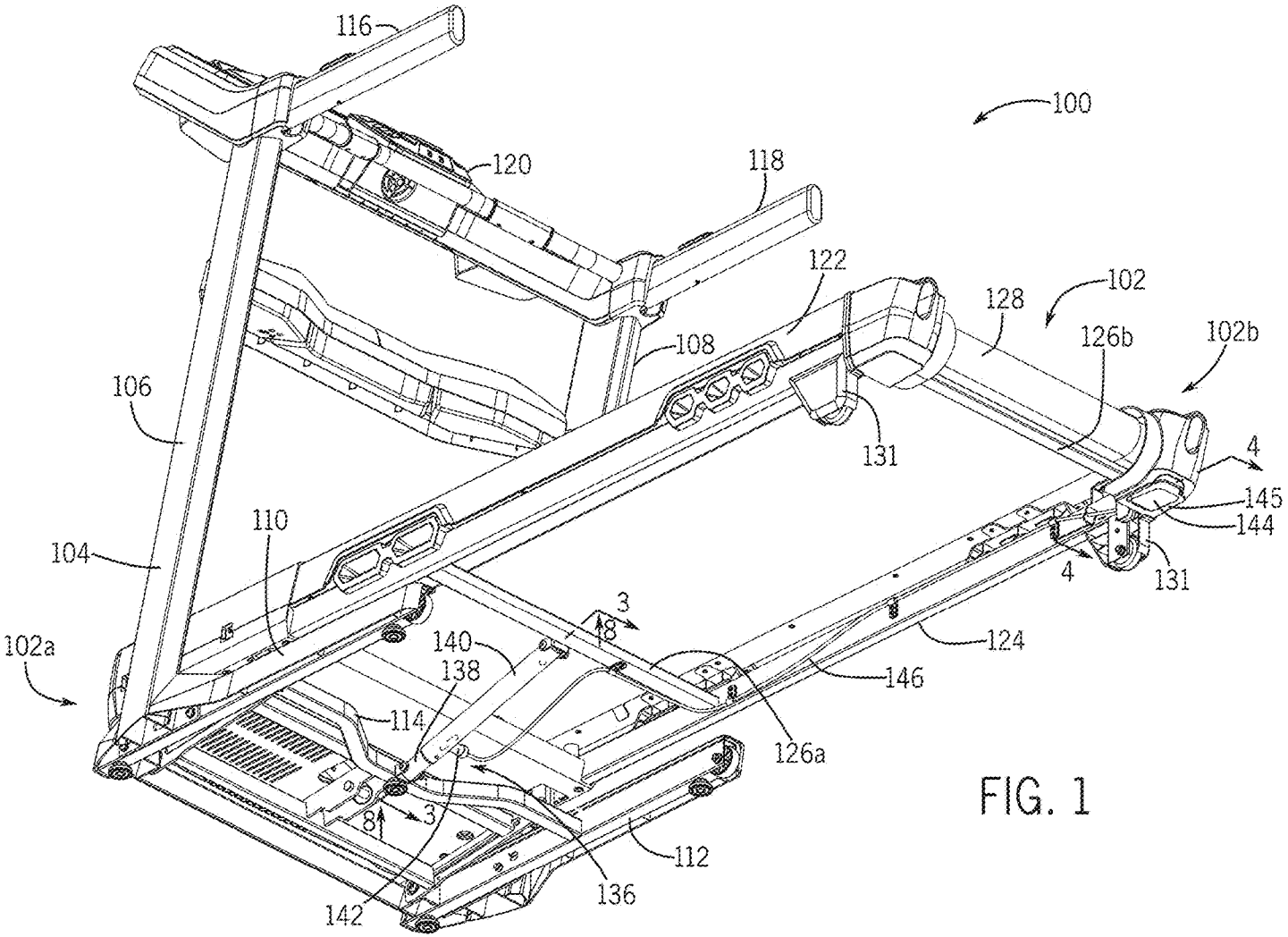
FIG. 1 is a bottom, left side isometric view of a treadmill including a deck assembly in an operating or use position in accordance with one embodiment of the present disclosure.
Figure 2:
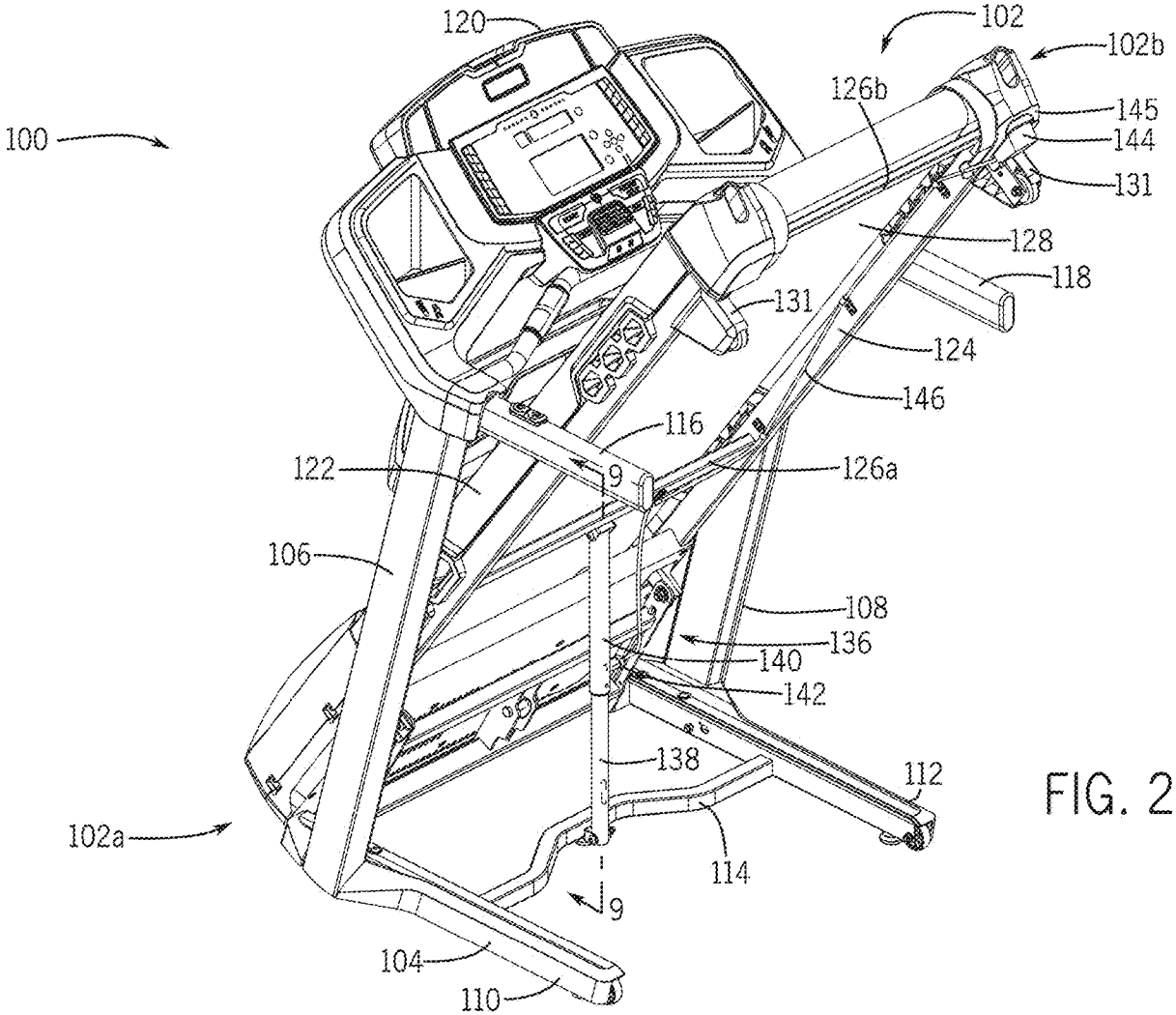
FIG. 2 is a top, left side isometric view of the treadmill of FIG. 1 with the deck assembly in a generally upright storage position according to one embodiment of the present disclosure.

FIGS. 1 and 2 show one example of a treadmill 100 with a lock system adapted to selectively lock the treadmill 100 in an operating configuration and a storage configuration. For example, FIG. 1 shows the treadmill 100 locked in the operating configuration, and FIG. 2 shows the treadmill 100 locked in the storage configuration. As shown in FIGS. 1 and 2, the exercise treadmill 100 includes a deck assembly 102 pivotally connected to a frame 104. A front end portion 102*a* of the deck assembly 102 may be pivotally connected to the frame 104, and a rear end portion 102*b* of the deck assembly 102 may be located distal the front end portion 102*a*. The rear end portion 102*b* of the deck assembly 102 may pivot about a pivotal connection of the front end portion 102*a* to the frame 104. When the treadmill 100 is in the operating configuration of FIG. 1, the deck assembly 102 may be oriented in a generally horizontal position and the rear end portion 102*b* of the deck assembly 102 may be supported by a support surface, such as a floor or the ground. To position the deck assembly 102 in the storage position of FIG. 2, a user may lift the rear end portion 102*b* of the deck assembly 102 upward, causing the deck assembly 102 to pivot around its pivotal connection to the base frame 102 until the deck assembly 102 extends upwardly in a generally vertical position (see FIG. 2).

With continued reference to FIGS. 1 and 2, the base frame 104 may include a left upright member 106 and a right upright member 108 extending upwardly from a left base member 110 and a right base member 112, respectively. The left and right base members 110, 112 may rest on a support surface, such as a floor or the ground, to provide a base or foundation for the treadmill 100 in the operating and storage configurations. A cross member 114, such as a cross bar, may extend between and connect to the left and right base members 110, 112. The cross member 114 may be positioned rearward of the pivotal connection of the deck assembly 102 to the frame 104. To provide a user with upper body support while using the treadmill 100, left and right hand rails 116, 118 may be connected with and extend rearwardly from the left and right upright members 106, 108, respectively. A display console 120 may be supported between the left and right upright members 106, 108.

The deck assembly 102 of FIGS. 1 and 2 may include a left frame rail 122 and a right frame rail 124, both extending rearwardly from the pivotal connection of the deck assembly 102 to the frame 104. The deck assembly 102 may include one or more cross members, such as cross bars, extending between the left and right frame rails 122, 124. For example, in FIGS. 1 and 2, the deck assembly 102 includes a first cross member 126*a* and a second cross member 126*b*. The first cross member 126*a* may be located rearwardly of the cross member 114 of the base frame 104, and the second cross member 126*b* may be located rearwardly of the first cross member 126*a* near the rearward end portion 102*b* of the deck assembly 102.

Referring still to FIGS. 1 and 2, the deck assembly 102 includes a tread belt 128 to provide a walking or running surface on the treadmill 100. The tread belt 128 may move over a treadmill deck 129 (see FIG. 3) between a front roller 130 (see FIG. 3) positioned near the front portion 102*a* of the deck assembly 102 and a rear roller positioned near the rear end portion 102*b* of the deck assembly 102. The front and rear rollers may be rotatably supported between the left and right frame rails 122, 124 of the deck assembly 102. As shown in FIGS. 1 and 2, the rear end portion 102*b* of the deck assembly 102 may include supports 131 extending downwardly from the left and right frame rails 122, 124 to elevate the tread belt 128 above a support surface, such as a floor or the ground, when the deck assembly 102 is in the operating position of FIG. 1. Wheels may be attached to the supports 131 for contact with the ground or floor.

The treadmill 100 of FIGS. 1 and 2 may include a lock system 136 for selectively locking the deck assembly 102 in the operating position of FIG. 1 and/or the storage position of FIG. 2. The lock system 136 may include a first elongate member, illustrated as an inner tube 138, and a second elongate member, illustrated as an outer tube 140, operatively connected to the deck assembly 102 and the frame 104. In FIG. 1, the inner tube 138 is connected to the frame 104 and the outer tube 140 is connected to the deck assembly 102, although the inner tube 138 may be connected to the deck assembly 102 and the outer tube 140 may be connected to the frame 104 without affecting the function of the lock system 136. As illustrated in FIGS. 1 and 2, the inner tube 138 may be slidably received in the outer tube 140 such that the outer tube 140 slides along an outer surface of the inner tube 138 during movement of the deck assembly 102 between the operating position in FIG. 1 and the storage position in FIG. 2.

With continued reference to FIGS. 1 and 2, the lock system 136 may include a lock mechanism 142 operative to lock the deck assembly 102 in the operating position of FIG. 1 and in the storage position of FIG. 2. The lock system 136 may extend between and connect to the deck assembly 102 and the frame 104. For example, in FIGS. 1 and 2, the lock system 136 extends between and connects to the cross member 126*a* of the deck assembly 102 and the cross member 114 of the base frame 104. The lock system 136 may be positioned substantially equidistant between the left and right frame rails 122, 124 along the length of the cross members 114, 126*a*. The lock mechanism 142 may be connected to the outer tube 140 and may selectively engage the inner tube 138 to fix the position of the outer tube 140 relative to the inner tube 138. The lock mechanism 142 may be selectively actuated by an actuator member 144 positioned remote from the lock mechanism 142. The actuator member 144 may be any component capable of disengaging the lock mechanism 142.

The actuator member 144 may be attached to the deck assembly 102. As shown in FIGS. 1 and 2, the actuator member 144 may be connected to the rear end portion 102*b* of the deck assembly 102 to provide easy access for a user. For example, the actuator member 144 may be connected to an end of one of the frame rails 122, 124 and may be located along an underside of the respective frame rail. The actuator member 144 may be substantially covered by a shroud 145 on the underside of the frame 124, with only a portion of the actuator member 144 exposed for actuation by a user. The actuator member 144 may be operatively connected to the lock mechanism 142 by a flexible member, such as cable 146. The cable 146 may be connected to the lock mechanism 142 at a first end, extend along one of the frame rails 122, 124, and be connected to the actuator member 144 at a second end. The cable 146 may be covered by a sheath between the ends of the cable 146. The cable 146 may be held in place along the frame rail 124 by one or more cable guides (e.g., cable guide 147 in FIG. 5).

Figure 3:
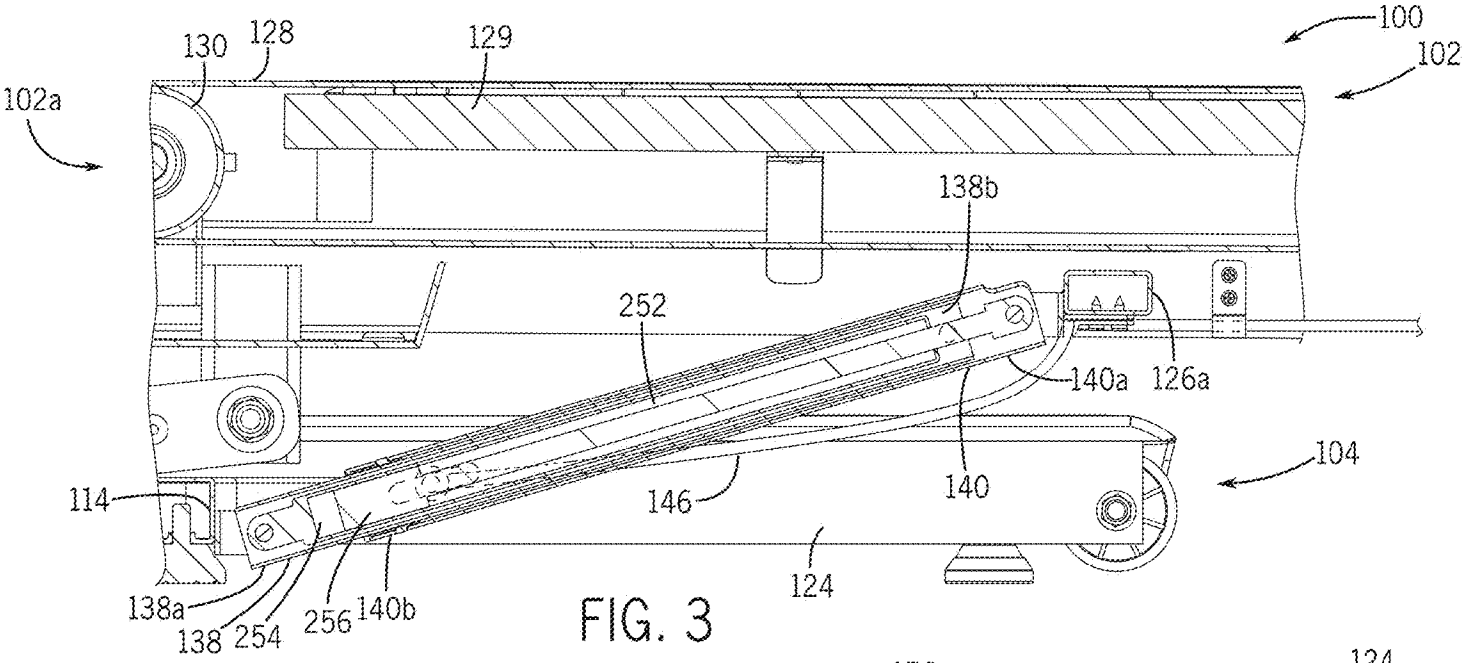
FIG. 3 is a cross-sectional view of a portion of the treadmill of FIG. 1 taken along line 3-3 in FIG. 1 according to one embodiment of the present disclosure.

FIG. 3 shows a cross-sectional view of the treadmill 100 taken along line 3-3 in FIG. 1. Referring to FIG. 3, the inner tube 138 may be telescopically received in the outer tube 140. The inner tube 138 may be pivotally connected at a first end portion 138*a* to the cross member 114 of the base frame 104 and may include a second end portion 138*b* distal the first end portion 138*a*. The outer tube 140 may be pivotally connected at a first end portion 140*a* to the cross member 126*a* of the deck assembly 102 and may include a second end portion 140*b* distal the first end portion 140*a*. The second end portion 138*b* of the inner tube 138 may be slidably received inside the outer tube 140 such that the outer tube 140 slides along an outer perimeter of the inner tube 138 during movement of the deck assembly 102 between the operating position shown in FIG. 1 and the storage position shown in FIG. 2.

Figure 4:
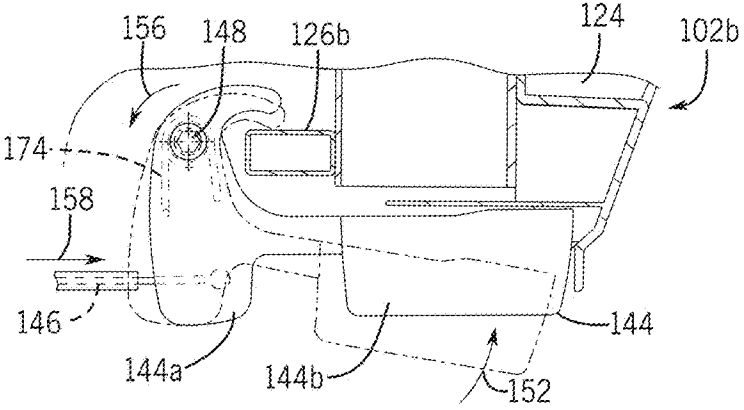
FIG. 4 is a cross-sectional view of a portion of the treadmill of FIG. 1 taken along line 4-4 in FIG. 1 according to one embodiment of the present disclosure.

To move the deck assembly 102 from the operating position shown in FIG. 1 to the storage position shown in FIG. 2, the user may engage the actuator member 144 to disengage the lock mechanism 142. Referring to FIG. 4, the actuator member 144 may be pivotally connected to the frame rail 124 near the rear end portion 102*b* of the deck assembly 102. By pressing upward on a rear end portion 144*b* of the actuator member 144 generally along arrow 152 in FIG. 4, the actuator member 144 pivots about a pivot axis 148 (see arrow 156) and causes a front end portion 144*a* of the actuator member 144 to move downwardly and rearwardly. This downward and rearward motion of the front end portion 144*a* of the actuator member 144 causes the cable 146 to move rearwardly generally along arrow 158 in FIG. 4. The rearward motion of the cable 146 disengages the lock mechanism 142, thereby permitting the deck assembly 102 to be moved upwardly relative to the frame 104 into the storage position of FIG. 2.

Figure 5:
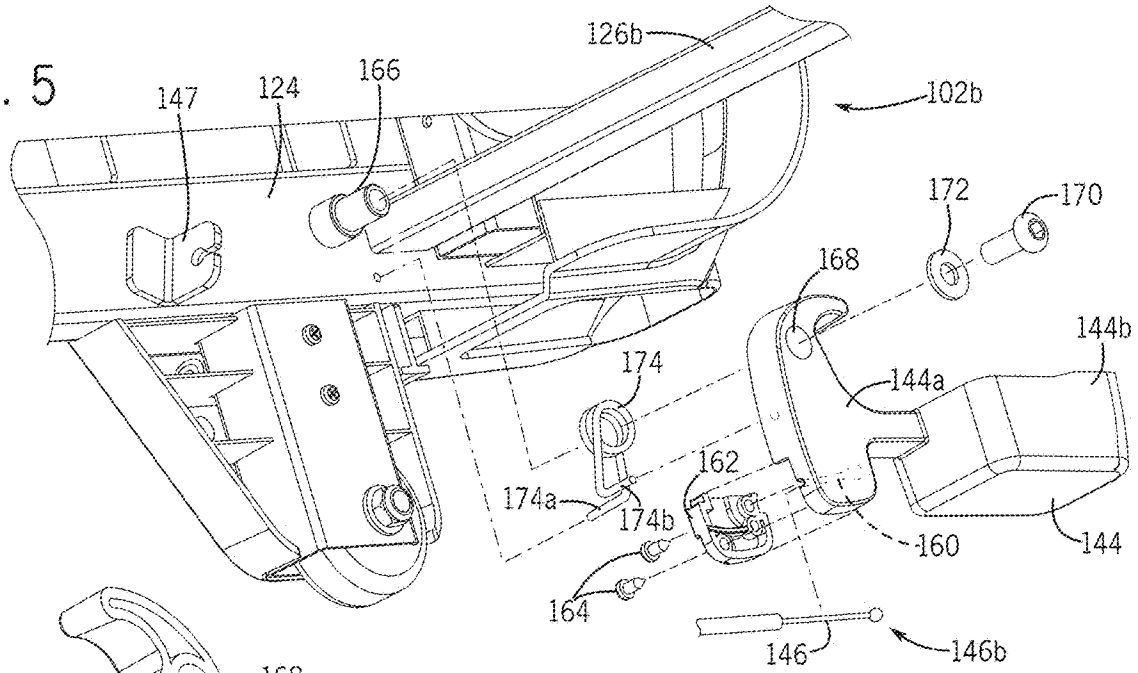
FIG. 5 is a partial exploded view of a portion of the treadmill of FIG. 1 according to one embodiment of the present disclosure.
Figure 6:
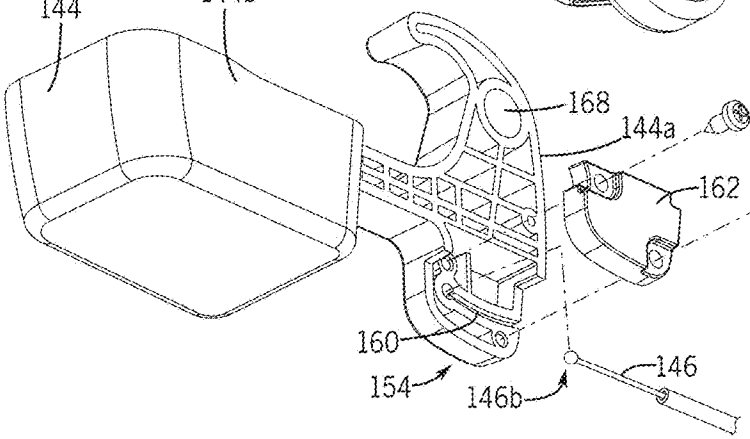
FIG. 6 is an exploded view of an actuator member according to one embodiment of the present disclosure.

Referring to FIGS. 5 and 6, the actuator member 144 may be operatively connected to the cable 146 such that movement of the actuator member 144 causes the cable 146 to move, and vice versa. The front end portion 144*a* of the actuator member 144 may define a channel 160 for receiving a rear end portion 146*b* of the cable 146, and a cover plate 162 may secure the rear end portion 146*b* in the channel 160. The cover plate 162 may be releasably connected to the front end portion 144*a* of the actuator member 144 with at least one fastener 164, for example.

With continued reference to FIGS. 5 and 6, the actuator member 144 may be pivotally mounted onto a post 166 projecting inwardly from the right frame rail 124 generally toward the left frame rail 122. The post 166 may be received within an aperture 168 formed in the front end portion 144*a* of the actuator member 144, and a fastener 170 may secure the front end portion 144*a* to the post 166. A washer 172 may be positioned between the front end portion 144*a* and the fastener 170.

Referring still to FIGS. 5 and 6, a biasing member 174 may bias the actuator member 144 into a position corresponding to an engaged position of the lock mechanism 142. The lock mechanism 142 may provide a sufficient biasing force to reset the actuator member 144 after being depressed by a user, and such biasing force may be transferred to the actuator member 144 through the cable 146. The biasing member 174 may optionally provide a supplemental biasing force to ensure the actuator member 144 is reset after being depressed by a user. For example, referring back to FIG. 4, the biasing member 174 may bias the actuator member 144 from a depressed position (see the solid-line representation of the actuator member 144 in FIG. 4) towards a non-depressed position (see the dashed-line representation of the actuator member 144 in FIG. 4), which movement may cause the cable 146 to move in a direction opposite that of arrow 158. To ensure the actuator member 144 is reset into a consistent non-depressed position, the actuator member 144 may contact a stop, such as the cross member 126*b*, when the actuator member 144 is fully reset.

With continued reference to FIGS. 5 and 6, the biasing member 174 may be a torsion spring. The torsion spring 174 may include a first tang 174*a* connected to the frame rail 124 and a second tang 174*b* connected to the front end portion 144*a* of the actuator member 144 such that the torsion spring 174 provides a biasing force upon pivotal movement of the actuator member 144 relative to the frame rail 124. The first and second tangs 174*a*, 174*b* may extend in generally opposite directions. As shown in FIG. 5, the biasing member 174 may be mounted onto the post 166 between the frame rail 124 and the front end portion 144*a* of the actuator member 144.

Figure 7:
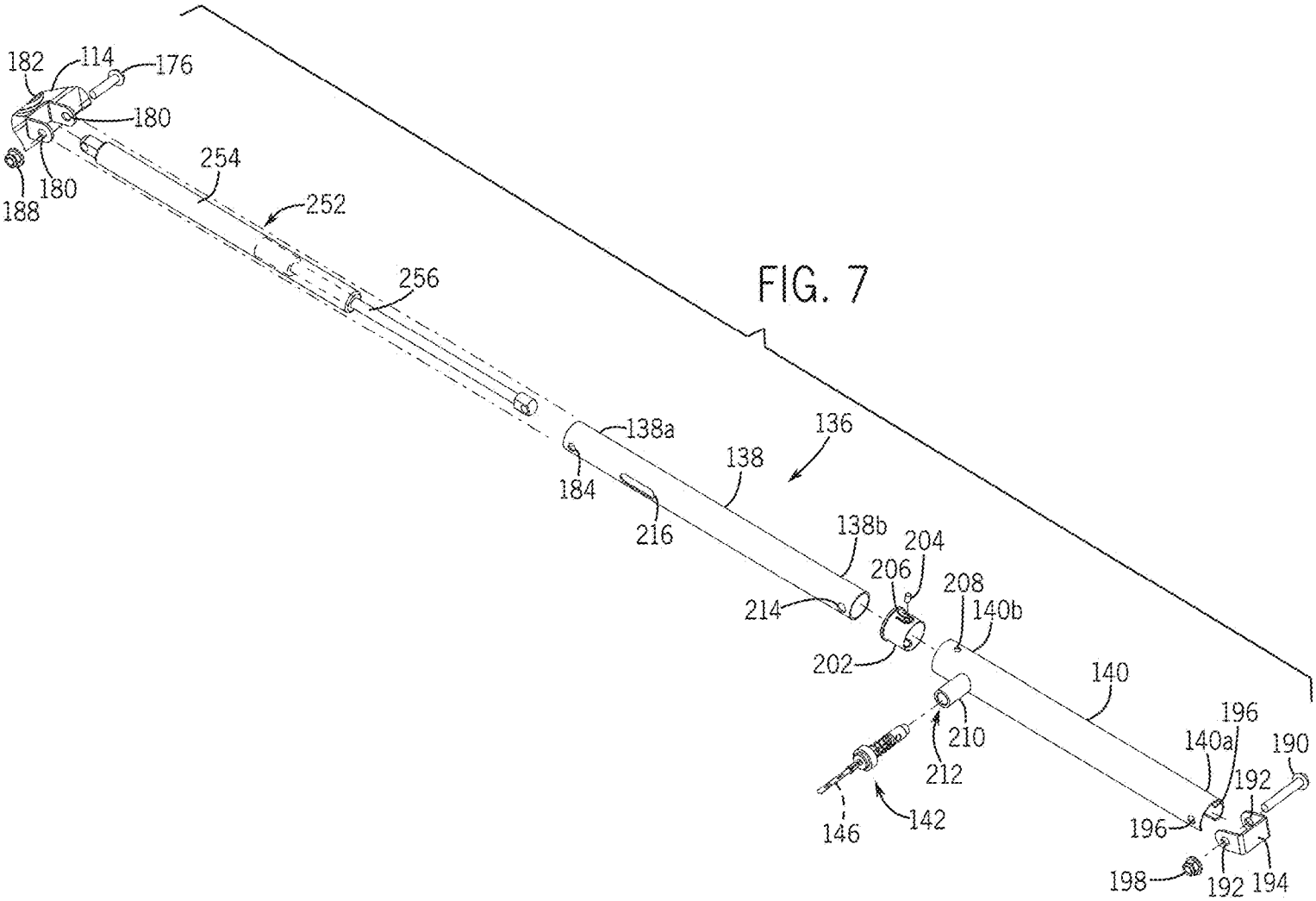
FIG. 7 is a partial exploded view of a lock system of the treadmill of FIG. 1 according to one embodiment of the present disclosure.

FIG. 7 shows a partial exploded view of the lock system 136 of the treadmill 100. The lock system 136 may include the inner tube 138 and the outer tube 140. The first end portion 138*a* of the inner tube 138 may be pivotally connected to the cross member 114 via a fastener, such as the illustrated bolt 176, that is inserted through apertures 180 formed in a bracket 182 (which is connected to the cross member 114) and apertures 184 formed in the first end portion 138*a* of the inner tube 138, and secured in place by a nut 188, for example. Similarly, the first end portion 140*a* of the outer tube 140 may be pivotally connected to the cross member 126*a* (see FIG. 3) via a fastener, such as the illustrated bolt 190, that is inserted through apertures 192 formed in a bracket 194 (which is connected to the cross member 126*a*) and apertures 196 formed in the first end portion 140*a* of the outer tube 140, and secured in place by a nut 198, for example. A collar 202 may be inserted into the end of the second end portion 140*b* of the outer tube 140 and secured in place by a fastener 204 inserted through an aperture 206 formed in the collar 202 and received in an aperture 208 formed in the second end portion 140*b*. The collar 202 may support the inner tube 138 within the outer tube 140 and may function as a bearing for the inner tube 138 to slide within during movement of the deck assembly 102 between the operating position of FIG. 1 and the storage position of FIG. 2.

With continued reference to FIG. 7, the lock mechanism 142 may be operatively connected to the outer tube 140 to selectively engage one or more engagement features of the inner tube 138. The lock mechanism 142 may be received within a housing 210 that is connected to the outer tube 140, and the housing 210 may define an interior cavity 212 that opens into an interior space of the outer tube 140. When received in the housing 210, the lock mechanism 142 may selectively protrude into the interior space of the outer tube 140 to engage the engagement features of the inner tube 138 to restrain the deck assembly 102 in the operating position of FIG. 1 or the storage position of FIG. 2. The lock mechanism 142 may be actuated by the movement of the cable 146, which may be caused by user movement of the actuator member 144 (see FIGS. 4-6).

Referring still to FIG. 7, the inner tube 138 may define multiple engagement features for engagement by the lock mechanism 142 to secure the deck assembly 102 in the operating position of FIG. 1 and the storage position of FIG. 2. The inner tube 138 may define a first engagement feature, such as the aperture 214, and a second engagement feature, such as the slot 216. The lock mechanism 142 may engage the aperture 214 when the deck assembly 102 is in the storage position of FIG. 2 and may engage the slot 216 when the deck assembly 102 is in the operating position of FIG. 1. The slot 216 may extend lengthwise along a length of the inner tube 138 and may be dimensioned to allow relative movement between the inner tube 138 and the outer tube 140 when the lock mechanism 142 is at least partially inserted into the slot 216. The relative movement between the inner tube 138 and the outer tube 140 may accommodate incline adjustment of the deck assembly 102 during operation of the treadmill 100, while ensuring the deck assembly 102 is secured in the operation position of FIG. 1.

Figures 8, 9, 10, 11:
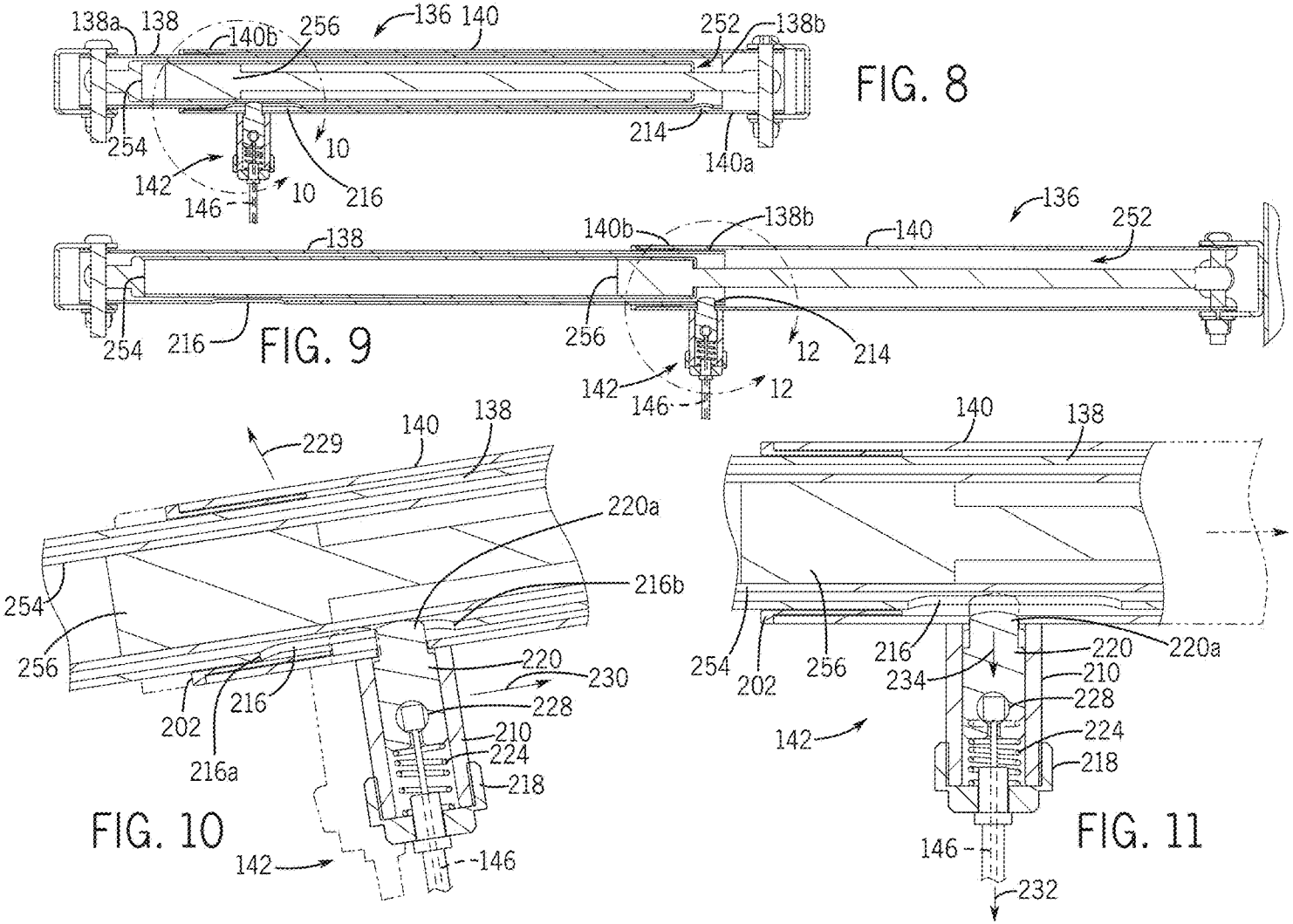
FIG. 8 is a cross-sectional view of the lock system of FIG. 7 taken along line 8-8 in FIG. 1 according to one embodiment of the present disclosure.
FIG. 9 is a cross-sectional view of the lock system of FIG. 7 taken along line 9-9 in FIG. 2 according to one embodiment of the present disclosure.
FIG. 10 is an enlarged view of the lock system of FIG. 8 circumscribed by line 10-10 in FIG. 8 according to one embodiment of the present disclosure.
FIG. 11 is an enlarged view of the lock system of FIG. 8 showing movement of a lock mechanism during inclination of deck assembly while using the treadmill according to one embodiment of the present disclosure.

FIGS. 8 and 9 show cross-sectional views of the lock system 136 when the treadmill 100 is in the operating and storage configurations of FIGS. 1 and 2, respectively. As illustrated in FIG. 8, when the treadmill 100 is in the operating configuration of FIG. 1, the first and outer tubes 138, 140 may be collapsed such that the second end portion 138*b* of the inner tube 138 is located close to the first end portion 140*a* of the outer tube 140, and the second end portion 140*b* of the outer tube 140 is located close to the first end portion 138*a* of the inner tube 138. When the treadmill 100 is in the operating configuration of FIG. 1, the lock mechanism 142 is inserted at least partially into the slot 216 of the inner tube 138, thereby permitting a user to adjust the incline of the deck assembly 102 without disengaging the lock mechanism 142 from the slot 216.

As illustrated in FIG. 9, when the treadmill 100 is in the storage configuration of FIG. 2, the inner and outer tubes 138, 140 may be extended away from each other such that the second end portion 140*b* of the outer tube 140 overlaps the second end portion 138*b* of the inner tube 138. When the treadmill 100 is in the storage configuration of FIG. 2, the lock mechanism 142 is inserted at least partially into the aperture 214 of the inner tube 138, thereby fixing the position of the first and outer tubes 138, 140 relative to each other and holding the deck assembly 102 in the storage position of FIG. 2.

Figure 12:
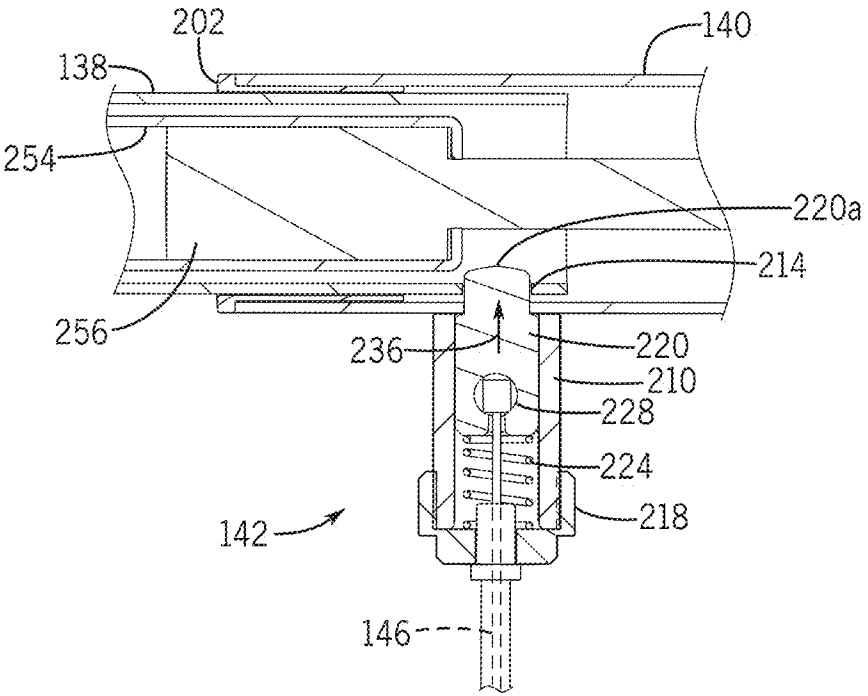
FIG. 12 is an enlarged view of the lock system of FIG. 9 circumscribed by line 12-12 in FIG. 9 according to one embodiment of the present disclosure.

FIGS. 10-12 provide enlarged views of the lock mechanism 142, which may be formed as a pop-pin assembly. As illustrated in FIGS. 10-12, the housing 210 of the lock mechanism 142 may be connected to the outer tube 140, and may be oriented substantially perpendicular to the outer tube 140. The housing 210 may be formed as a cylinder and a cap 218 may be mounted onto the housing 210 to secure an engagement member 220 within the housing 210. The engagement member 220 may be slidably received within the housing 210 such that the engagement member 220 is movable between an engaged position in which the engagement member engages the first or second engagement features of the inner tube 138 and a disengagement position in which the engagement member is disengaged from the first and second engagement features of the inner tube 138. The engagement member 220 may be referred to as a pin. A biasing member, such as a spring 224, may be disposed between the housing cap 218 and the engagement member 220, and the spring 224 may urge the engagement member 220 away from the housing cap 218 and toward the inner tube 138. The cable 146 may be insertable through an aperture formed in the housing cap 218 and connected to the engagement member 220. As illustrated in FIGS. 10-12, an end of the cable 146 may be retained in an aperture 228 formed in the engagement member 220. Alternatively, the cable 146 may be attached to the engagement member 220 by any known method or device.

In operation, the spring 224 in FIGS. 10-12 may apply a biasing force to the engagement member 220, thereby urging an end portion 220*a* of the engagement member 220 to extend from the housing 210 into an interior space defined by the outer tube 140. By extending into the interior space defined by the outer tube 140, the end portion 220*a* of the engagement member 220 may extend into the aperture 214 of the inner tube 138 when the end portion 220*a* is aligned with the aperture 214, the slot 216 of the inner tube 138 when the end portion 220*a* is aligned with the slot 216, or may ride along an outer surface of the inner tube 138 when the end portion 220*a* is not aligned with the aperture 214 or the slot 216. The extension of the engagement member 220 into the aperture 214 generally prevents relative movement between the inner tube 138 and the outer tube 140, thereby precluding movement of the deck assembly 102 relative to the base frame 104. The extension of the engagement member 220 into the slot 216 generally confines movement of the inner tube 138 relative to the outer tube 140, thereby limiting movement of the deck assembly 102 relative to the base frame 104. According to one embodiment, the engagement member 220 is received within the aperture 214 when the treadmill 100 is in the storage configuration of FIG. 2, and the engagement member 220 is received within the slot 216 when the treadmill 100 is in the operating configuration of FIG. 1.

During use of the treadmill 100, a user may adjust the incline of the deck assembly 102, causing the front end portion 102*a* of the deck assembly 102 to rise relative to the rear end portion 102*b*. During this inclination of the deck assembly 102, the first and outer tubes 138, 140 generally pivot in an upward direction (see arrow 229 in FIG. 10) about the pivot connection of the inner tube 138 to the base frame 104, and the first and outer tubes 138, 140 move linearly away from each other as the distance between their connection points to the base frame 104 and the deck assembly 102, respectively, increases. During this separation of the first and outer tubes 138, 140, the lock mechanism 142 generally moves in unison with the outer tube 140 (see arrow 230 in FIG. 10), causing the end portion 220*a* of the engagement member 220 to slide within the slot 216. The length of the slot 216 may be based on a maximum incline angle of the deck assembly 102.

Referring to FIG. 10, when the treadmill is in the operating configuration of FIG. 1, the engagement member 220 may extend into the slot 216 of the inner tube 138. As shown in FIG. 10, the slot 216 is elongated and has a length defined between a lower end 216*a* and an upper end 216*b*. The engagement member 220 may be spaced from the upper end 216*b* of the slot 216 when the deck assembly 102 is oriented generally horizontally (see dashed line representation of the engagement member 220 in FIG. 10), and the distance between the engagement member 220 and the upper end 216 of the slot 216 generally permits incline adjustment of the deck assembly 102 while the engagement member 220 is positioned within the slot 216. During incline of the deck assembly 102, the end portion 220*a* of the engagement member 220 may slide in a substantially straight line along the length of the slot 216 toward the upper end 216*b* of the slot 216 and the second end portion 138*b* of the inner tube 138 (see FIG. 8 and arrow 230 in FIG. 10).

Referring still to FIG. 10, lifting of the rear end portion 102*b* of the deck assembly 102 (resulting in a decline of the deck assembly 102) may cause the engagement member 220 to slide within the slot 216 toward the upper end 216*b* of the slot 216 and the second end portion 138*b* of the inner tube 138. As such, when the deck assembly 102 is in the operating position of FIG. 1, a user may lift the rear end portion 102*b* of the deck assembly 102 a distance without having to first extract the engagement member 220 from the slot 216. In other words, a user may lift the rear end portion 102*b* of the deck assembly 102 until the end portion 220*a* of the engagement member 220 abuts against the upper end 216*b* of the slot 216, at which point the user may depress the actuator member 144 (see FIG. 1) to disengage the engagement member 220 from the slot 216 and continue lifting the rear end portion 102*b* of the deck assembly 102 toward the storage position of FIG. 2.

Referring to FIG. 11, to reposition the treadmill 100 from the operating position of FIG. 1 into the storage configuration of FIG. 2 (see FIGS. 1 and 2), the user may reach under the rear end portion 102*b* of the deck assembly 102 (see FIG. 1) and apply an upward force on the actuator member 144 to pivot the actuator member 144 relative to the frame rail 124 (see FIG. 4), causing the cable 146 to move transversely away from the first and outer tubes 138, 140 (see arrow 232 in FIG. 11) against the bias of spring 224 until the end portion 220*a* of the engagement member 220 is extracted from the slot 216 (see arrow 234 in FIG. 11 representing the motion of the engagement member 220 from an extended position (dashed line representation) to a non-extended position (solid line representation)). As previously described, the user may lift the rear end portion 102*b* of the deck assembly 102 slightly before depressing the actuator member 144 to provide the user better initial access to the actuator member 144. Once the engagement member 220 is extracted from the slot 216 (see FIG. 11), the outer tube 140 is free to move relative to the inner tube 138, and thus the deck assembly 102 is free to pivot relative to the base frame 104. Once the user moves the deck assembly 102 upward a sufficient distance such that the engagement member 220 is no longer in alignment with the slot 216 in the inner tube 138, the user may release the actuator member 144, which allows the spring 224 to force the end portion 220*a* of the engagement member 220 against the side wall of the inner tube 138.

Referring to FIG. 12, once the deck assembly 102 is lifted to the upright storage position such that the engagement member 220 is aligned with the aperture 214, the spring 224 forces the end portion 220*a* of the engagement member 220 into the aperture 214 (see arrow 236 in FIG. 12), which holds the inner tube 138 in a fixed position relative to the outer tube 140, locking the deck assembly 102 in the storage position of FIG. 2. The force of the spring 224 may cause the cable 146 to move away from the actuator member 144 and reset the position of the actuator member 144 (see dashed line representation of actuator member in FIG. 4). To return the deck assembly 102 to the operating configuration of FIG. 1, the user may depress the actuator member 144 to extract the end portion 220*a* of the engagement member 220 from the aperture 214 and then lower the deck assembly 220 until the spring 224 forces the end portion 220*a* of the engagement member 220 into the slot 216 (see FIG. 8). With the engagement member 220 engaged in the slot 216, a user may adjust the incline of the deck assembly 102 relative to the frame 104 without extracting the engagement member 220 from the slot 216.

FIGS. 3 and 7-9 show a lift assistance mechanism 252 configured to resist pivotal movement of the deck assembly 102 in the downward direction. The lift assistance mechanism 252 controls the rate at which the deck assembly 102 moves when pivoting downward from the storage position of FIG. 2 to the operating position of FIG. 1 to prevent the deck assembly 102 from pivoting downward at a relatively high rate of speed, such as during a free fall. In addition, the lift assistance mechanism 252 facilitates lifting and pivoting of the deck assembly 102 from the operating configuration of FIG. 1 to the storage configuration of FIG. 1 by providing a supplemental force that reduces the force required to lift and pivot the deck assembly 102. Embodiments of the lift assistance mechanism 252 described and depicted herein can be used with various types of exercise treadmills and should not be construed to be limited to use with the treadmill disclosed herein.

In the embodiment shown in FIGS. 3 and 7-9, the lift assistance mechanism 252 is positioned inside the inner tube 138 and the outer tube 140. The illustrated lift assistance mechanism 252 comprises a lift cylinder including a cylinder body 254 operatively connected with a piston 256. As shown in FIG. 3, the cylinder body 254 may be pivotally connected to the cross member 114 of the base frame 104 at the same pivot connection as the inner tube 138 to the cross member 114, and the piston 256 may be pivotally connected to the cross member 126*a* of the deck assembly 102 at the same pivot connection as the outer tube 140 to the cross member 126*a*. The piston 256 may include a head positioned within the cylinder body 254, and the cylinder body 254 may contain pressurized air that resists downward motion of the piston head within the cylinder body 254, thereby resisting downward pivotal motion of the deck assembly 102 relative to the base frame 104. In other words, pressurized air inside the cylinder body 254 acts to force the piston head away from the pivotal connection of the cylinder body 254 to the cross member 114 of the base frame 104, which in turn resists downward pivotal motion of the deck assembly 102 relative to the base frame 104. During use, the piston 256 extends from and compresses into the cylinder body 254 as the deck assembly 102 pivots up and down relative to the base frame 104, respectively. As shown in FIG. 9, the lift cylinder 252 defines a relatively extended length when the deck assembly 102 is in the upright storage position of FIG. 2. Conversely, as shown in FIG. 8, the lift cylinder 252 defines a relatively compressed length when the deck assembly 102 is in the downward operating position of FIG. 1. As the deck assembly 102 pivots from the storage position of FIG. 2 to the operating position of FIG. 1, movement of the piston 256 into the cylinder body 254 may cause the air pressure inside the cylinder body 254 to increase, resulting in an increased force exerted by the lift cylinder.

Various sizes, types, and arrangements of lift cylinders may be used and are not limited to the arrangement depicted and described herein. Depending on the length and weight of the deck assembly, the lift mechanism may include more than one lift cylinder. Further, the lift assistance mechanism is not limited to having air pressurized lift cylinders and can include any mechanism capable of applying an upward force on the deck assembly, such as a spring or hydraulic system.

In use, a user can disengage the lock mechanism 142 by applying an upward force to the actuator member 144. More particularly, when a user presses upward on the actuator member 144, the actuator member 144 pulls the cable 146 attached thereto in a rearward direction, and the cable 146 in turn operates to disengage the lock mechanism 142. As previously described, the movement of the cable 146 may cause the engagement member 220 to be withdrawn from the aperture 214 and the slot 216 in the inner tube 138, thereby disengaging the lock mechanism 142 and enabling repositioning of the deck assembly 102 between operating and storage positions. When the user releases the actuator member 144, the spring 224 extends the engagement member 220 toward the inner tube 138, which causes the cable 146 to pull on the actuator member 144 and pivot the actuator member 144 into its original non-depressed position.

Using the actuator member 144 with the lock mechanism 142 is merely exemplary. For example, the actuator member 144 may be used with other lock mechanisms capable of restricting relative movement between the first and outer tubes 138, 140, and similarly the lock mechanism 142 may be used with other actuator members capable of moving the engagement member 220 between extended and non-extended positions. For example, instead of having the lever described above, other forms of the actuator member may include a knob or handle located on the deck assembly and adapted to slide, pivot, rotate, or move in other manners to actuate the lock mechanism. The actuator member may be operatively connected with the engagement member mechanically, electrically (wired or wirelessly), or both. The term "tube" as used herein includes structures that are at least partially hollow, have a length dimension longer than a width dimension, and may include a cross section that is continuous or discontinuous along its length. The cross sectional shape of an example tube may be of a geometric shape, such as including without limitation circular, oval, square, rectangular, trapezoidal, or star-shaped. The cross sectional shape of an example tube may receive another tube having a corresponding cross sectional shape or another shape such that the two tubes are telescopically movable relative to one another.

Referring to FIGS. 13-22, the lift assistance mechanism 252 (see FIGS. 3 and 7-9) may be movable relative to the angle of the deck assembly 102. By adjusting its angle relative to the deck assembly 102, the lift assistance mechanism 252 may at least one of assist a lift motor 260 in raising the front end portion 102*a* of the deck assembly 102, assist the rear end portion 102*b* of the deck assembly 102 in maintaining contact with a support surface (e.g., the ground) during inclination of the deck assembly 102, or assist a user in lifting the rear end portion 102*b* of the deck assembly 102 to reposition the deck assembly 102 into a storage configuration. For example, the angle-adjusted lift assistance mechanism 252 may exert a reduced force on the deck assembly 102 during inclination of the deck assembly 102 such that the rear end portion 102*b* of the deck assembly 102 does not lift off the ground when the deck assembly 102 is inclined during operation. Additionally or alternatively, the angle-adjusted lift assistance mechanism 252 may provide a sufficient lift force to the deck assembly 102 for storage such that the force required to lift the rear end portion 102*b* of the deck assembly 102 to move the deck assembly 102 from the operating position to the storage position is below a threshold requirement (e.g., 150N at 15 degrees), which may be set by one or more industry organizations.

To adjust its angle relative to the deck assembly 102, the lift assistance mechanism 252 may be supported by the base frame 104 at a support location 252*a* and connected to the deck assembly 102 at a connection 252*b*. At least one of the support location 252*a* or the connection 252*b* may be movable along a length L (see FIGS. 14 and 15) of the treadmill 100. For example, the support location 252*a* may be movable along the length L of the treadmill 100 relative to the frame 104 to adjust an angle between the lift assistance mechanism 252 and the deck assembly 102 during movement of the deck assembly 102. In some embodiments, the lift assistance mechanism 252 may be pivotally and slidably connected to the base frame 104 at the support location 252*a* and may be pivotally connected to the deck assembly 102 at the connection 252*b*. Referring to FIGS. 13-22, a fragmentary view of the treadmill 100 illustrated in FIGS. 1-12 is provided, and the lift assistance mechanism 252 is represented in dashed line inside the inner tube 138 and the outer tube 140 similar to FIGS. 3 and 7-9. In FIGS. 1-12, the lift assistance mechanism 252 is pivotally connected to the deck assembly 102 and to the base frame 104. In FIGS. 13-22, the lift assistance mechanism 252 is pivotally connected to the deck assembly 102, similar to FIGS. 1-12. However, in FIGS. 13-22, the lift assistance mechanism 252 is pivotally and translateably connected to the base frame 104 to permit movement of the support location 252*a* of the lift assistance mechanism 252 relative to the base frame 104, in contrast to FIGS. 1-12 in which the lift assistance mechanism 252 is pivotally, but not translateably, connected to the base frame 104.

Figure 13:
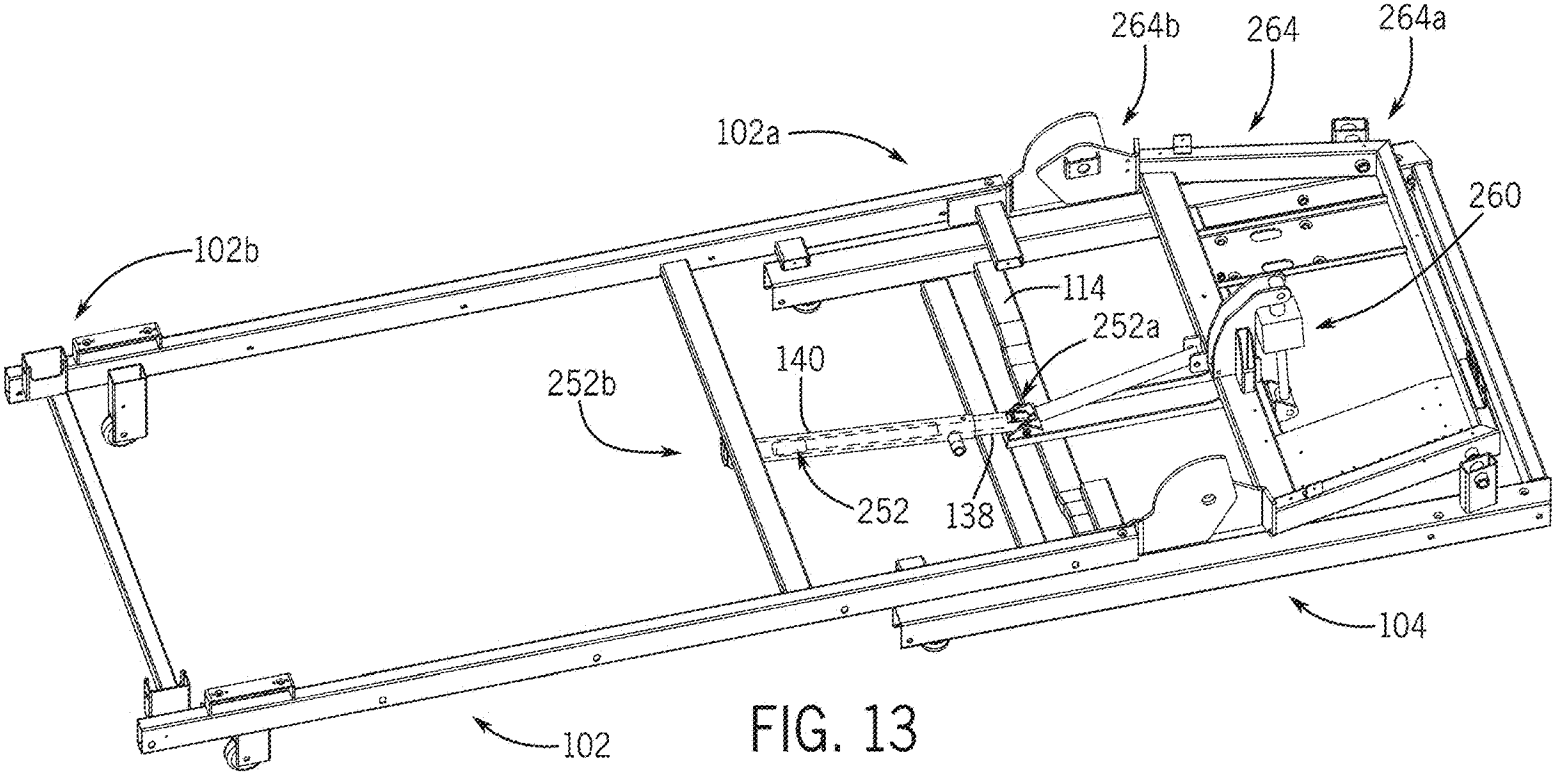
FIG. 13 is a top, right side perspective fragmentary view of the treadmill of FIG. 1 with a lift assistance mechanism operatively coupled to the deck assembly and a frame of the treadmill according to one embodiment of the present disclosure.
Figure 14:
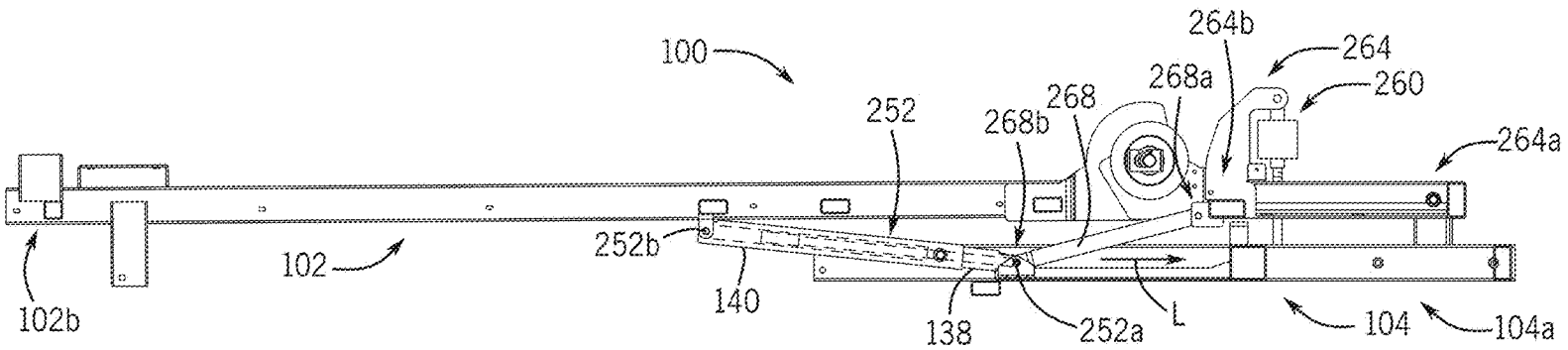
FIG. 14 is a right side elevation view of the fragmentary treadmill of FIG. 13 with the deck assembly in a generally horizontal operating or use position according to one embodiment of the present disclosure.
Figure 15:
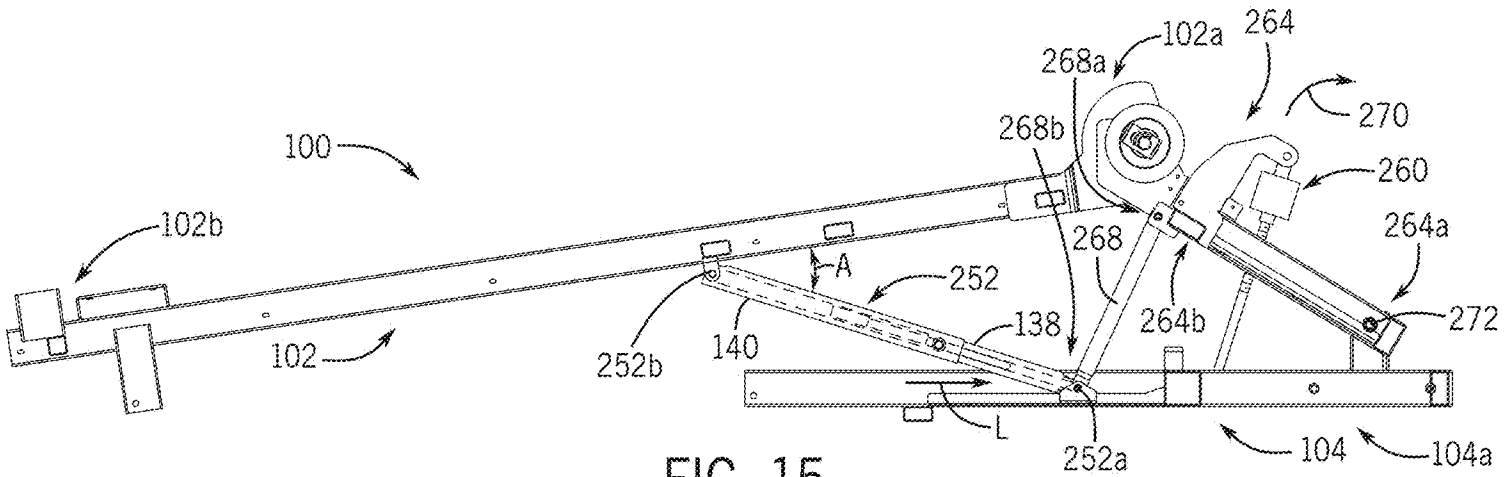
FIG. 15 is a right side elevation view of the fragmentary treadmill of FIG. 13 with the deck assembly in an inclined operating or use position according to one embodiment of the present disclosure.

Referring to FIGS. 13-22, the support location 252*a* of the lift assistance mechanism 252 may be pivotally connected to the base frame 104 such that the support location 252*a* is movable along the length L of the frame 104. Referring to FIGS. 14 and 15, the support location 252*a* of the lift assistance mechanism 252 may be movable between a first position and a second position along the length L of the treadmill 100 when the deck assembly 102 is positioned in the operating or use position. Referring collectively to FIGS. 14 and 15, the support location 252*a* may move from the first position (see FIG. 14) to the second position (see FIG. 15) during inclination of the deck assembly 102 while in the operating position. As shown in FIG. 14, the support location 252*a* of the lift assistance mechanism 252 may be positioned in a rearward position along the length L of the treadmill when the treadmill 100 is in the non-inclined operating position. As shown in FIG. 15, the support location 252*a* of the lift assistance mechanism 252 may be positioned in a forward position along the length L of the treadmill when the treadmill 100 is in an inclined operating position. As shown in FIGS. 13 and 18, the support location 252*a* of the lift assistance mechanism 252 may be positioned proximate the cross member 114 in the rearward position. The distance between the rearward position and the forward position depends on the amount of incline set by the user during use.

During inclination of the deck assembly 102, the support location 252*a* may move forwardly in a substantially straight line along the length L of the treadmill 100. By moving forwardly in a substantially straight line, the support location 252*a* may reduce the angle A defined between the lift assistance mechanism 252 and the deck assembly 102 relative to the angle defined between the lift assistance mechanism 252 and the deck assembly 102 if the support location 252*a* was not translateable along the length L of the treadmill 100. Reducing the angle A between the lift assistance mechanism 252 and the deck assembly 102 may reduce the upward force exerted on the deck assembly 102 by the lift assistance mechanism 252 during inclination of the deck assembly 102, and the resulting upward force may be insufficient to lift the rear end portion 102*b* of the deck assembly 102 off the ground when the deck assembly 102 is inclined.

With continued reference to FIGS. 14 and 15, the treadmill 100 may include an incline assembly 264 for raising the front end portion 102*a* of the deck assembly 102 relative to the rear end portion 102*b* to incline the deck assembly 102 during use. The incline assembly 264 may be connected to the deck assembly 102 and supported by the base frame 104. For example, the incline assembly 264 may include a rear end portion 264*b* pivotally connected to the front end portion 102*a* of the deck assembly 102 and may include a front end portion 264*a* pivotally connected to a front end portion 104*a* of the base frame 104. A lift motor 260 of the incline assembly 264 may be connected to the base frame 104 and may be operative to raise or lower the rear end portion 264*b* of the incline assembly 264 relative to the front end portion 264*a* according to a user's preference. By raising or lowering the rear end portion 264*b* of the incline assembly 264, the lift motor 260 may raise or lower the front end portion 102*a* of the deck assembly 102 relative to the rear end portion 102*b* of the deck assembly 102 according to a user's incline preference of the deck assembly 102.

Figure 18A:
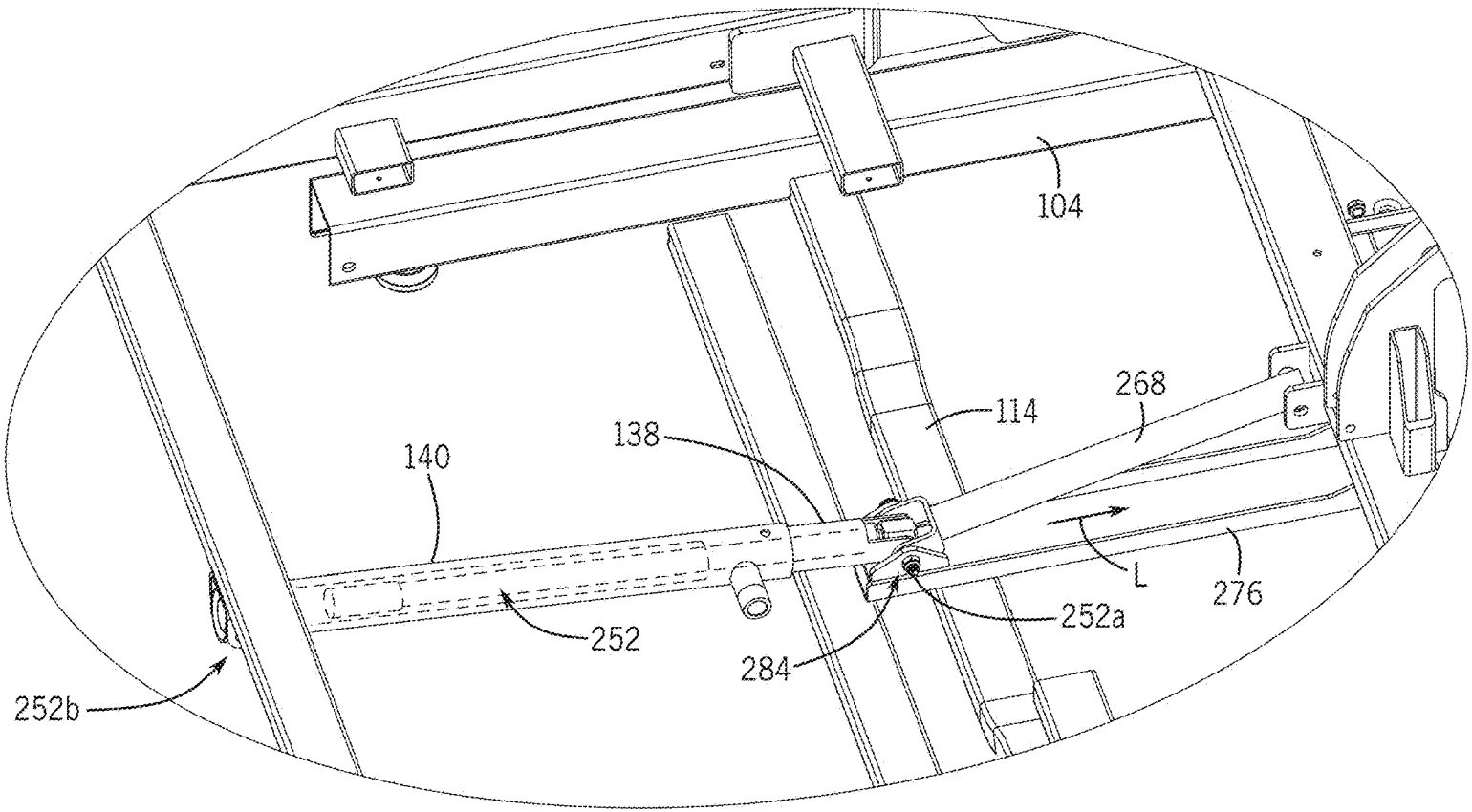
FIG. 18A is an enlarged view of the lift assistance mechanism of FIG. 13 associated with a fixed-length link according to one embodiment of the present disclosure.
Figure 18B:
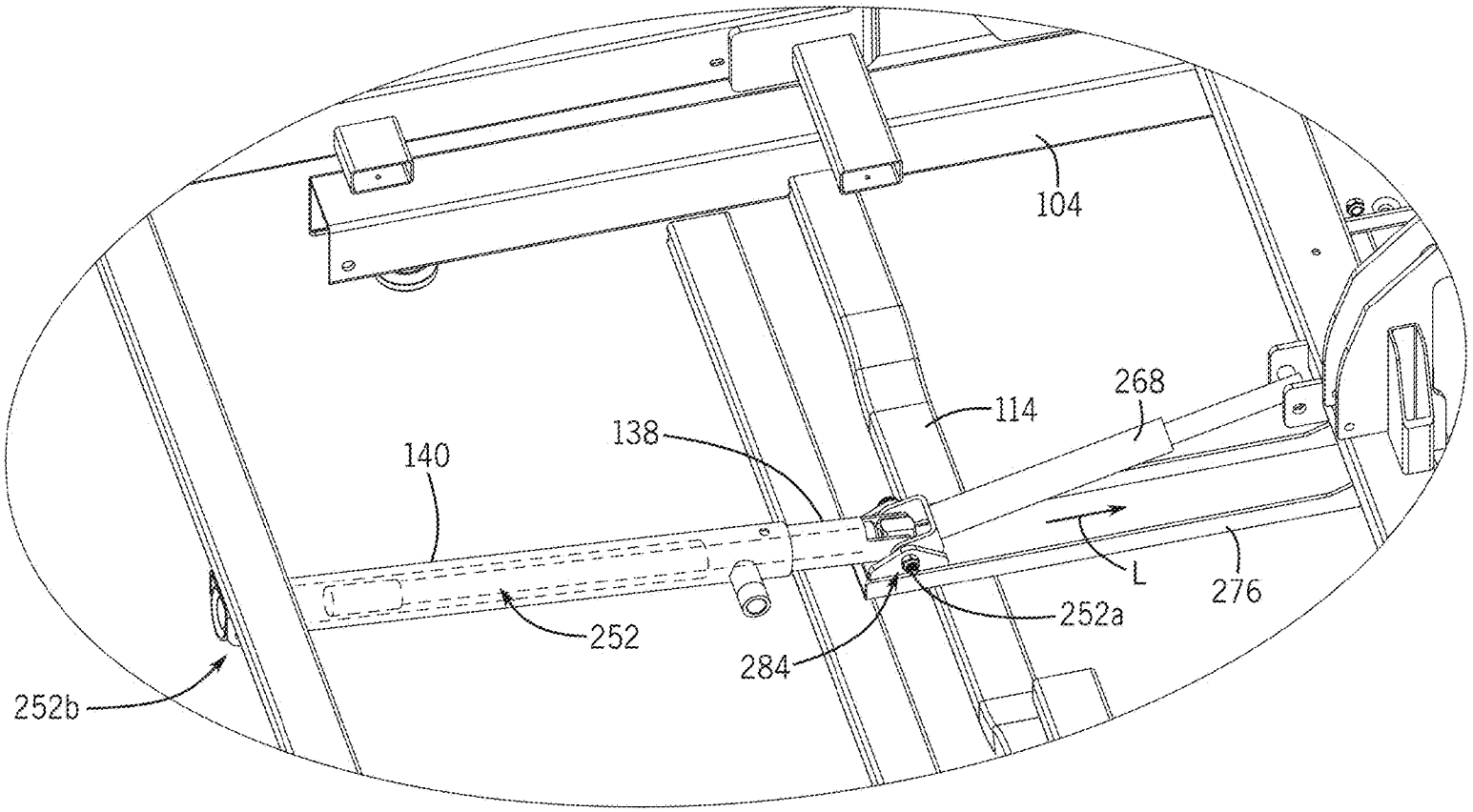
FIG. 18B is an enlarged view of the lift assistance mechanism of FIG. 13 associated with a variable-length link according to one embodiment of the present disclosure.

Referring still to FIGS. 14 and 15, the lift assistance mechanism 252 may be operatively connected to the incline assembly 264 such that pivotal motion of the incline assembly 264 causes the support location 252*a* to move along the length L of the treadmill 100. For example, raising or lowering of the rear end portion 264*b* of the incline assembly 264 may cause the support location 252*a* to move forwardly or rearwardly, respectively, relative to the base frame 104. As shown in FIGS. 14 and 15, the lift assistance mechanism 252 may be connected to the incline assembly 264 by a link 268. As illustrated in FIG. 18A, the link 268 may have a fixed length defined by the distance between its front end portion 268*a* and its rear end portion 268*b*. Alternatively, as illustrated in FIG. 18B, the link 268 may have a variable length. For example, the link 268 may be formed as a shock (as illustrated in FIG. 18B), a spring, or another structure that is variable in length. Referring back to FIGS. 14 and 15, the link 268 may be pivotally connected to the lift assistance mechanism 252 at its rear end portion 268*b* and may be pivotally connected to the incline assembly 264 at its front end portion 268*a*. The rear end portion 268*b* of the link 268 may be pivotally connected to the lift assistance mechanism 252 at the support location 252*a*. The support location 252*a* and the rear end portion 268*b* of the link 268 may move together in unison along the length L of the treadmill 100.

With further reference to FIGS. 14 and 15, movement of the support location 252*a* of the lift assistance mechanism 252 in a forward direction during inclination of the deck assembly 102 may assist the lift motor 260 in inclining the deck assembly 102. During inclination of the deck assembly 102, the lift motor 260 and the lift assistance mechanism 252 may pivot the incline assembly 264 in an upward direction (see arrow 270 in FIG. 15) about the pivot connection 272 of the front end portion 264*a* of the incline assembly 264 to the base frame 104. The upward motion of the rear end portion 264*b* of the incline assembly 264 may raise the front end portion 102*a* of the deck assembly 102 to incline the deck assembly 102. During inclination of the deck assembly 102, the lift assistance mechanism 252 may be biased to elongate (e.g., via a lift cylinder), causing the support location 252*a* to move forwardly along the length L of the treadmill 100. The forward movement of the support location 252*a* may cause the rear end portion 268*b* of the link 268 to move in a forward direction, which may cause the front end portion 268*a* of the link 268 to move in a forward and/or upward direction, thereby causing the incline assembly 264 to pivot in an upward direction and provide a supplemental force to lift the front end portion 102*a* of the deck assembly 102. By directing the axial force of the lift assistance mechanism 252 to the link 268, the force exerted on the deck assembly 102 through the connection 252*b* of the lift assistance mechanism 252 may be reduced such that the lift assistance mechanism 252 does not lift the rear end portion 102*b* of the deck assembly 102 off the ground during incline adjustment of the deck assembly 102. Because of the supplemental lift force provided by the lift assistance mechanism 252 to the front end portion 102*a* of the deck assembly 102, a smaller and/or less expensive lift motor 260 may be used to incline the deck assembly 102.

Figure 16:
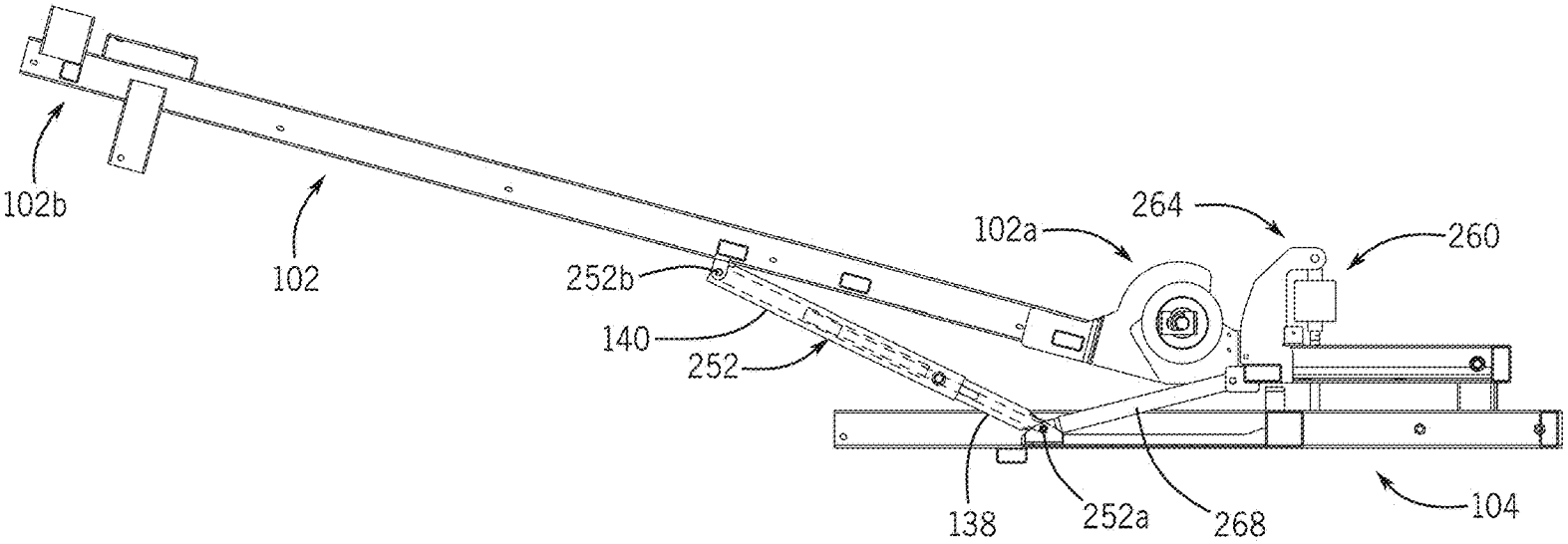
FIG. 16 is a right side elevation view of the fragmentary treadmill of FIG. 13 with the deck assembly positioned between an operating or use position and a generally upright storage position according to one embodiment of the present disclosure.
Figure 17:
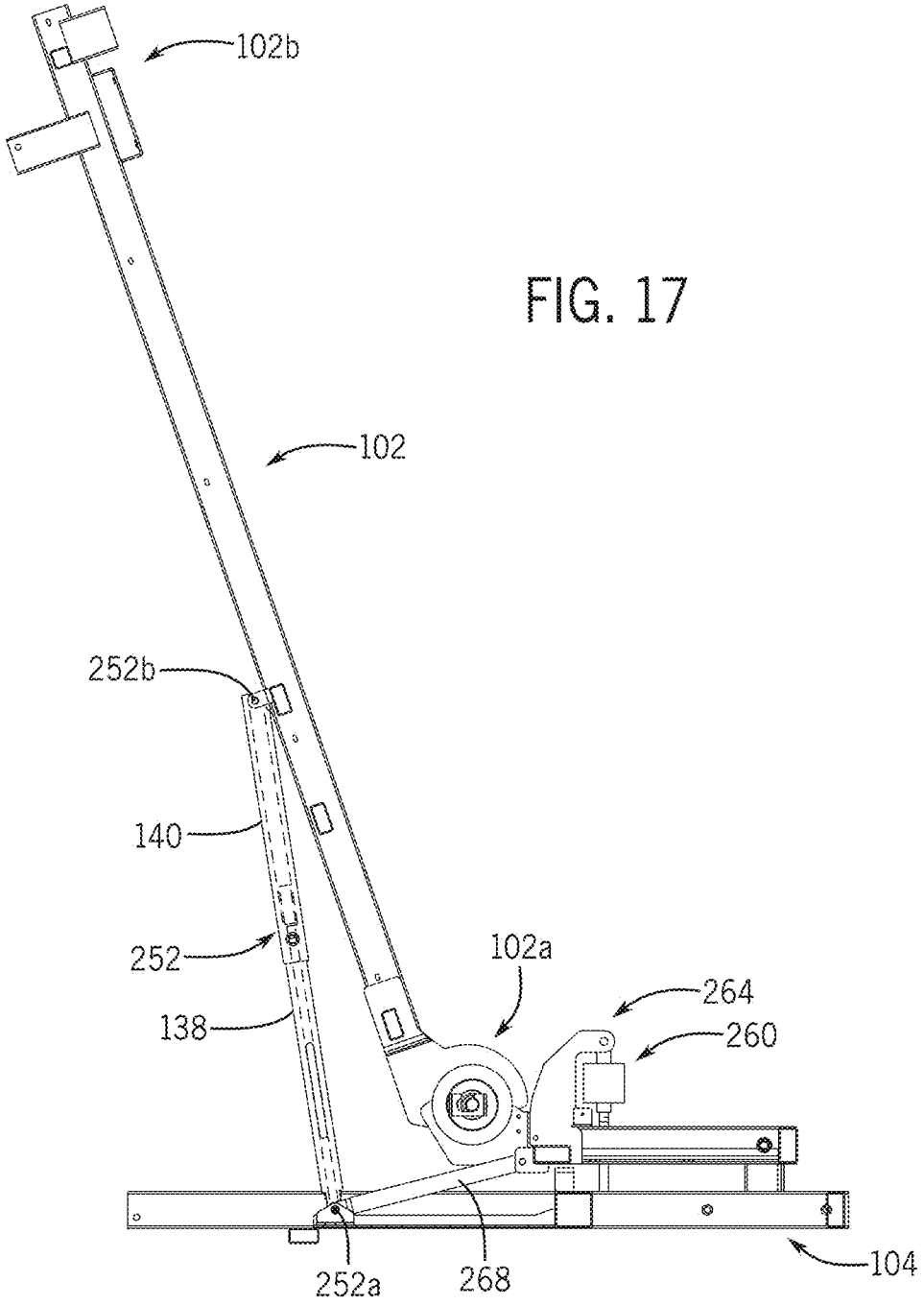
FIG. 17 is a right side elevation view of the fragmentary treadmill of FIG. 13 with the deck assembly in a generally upright storage position according to one embodiment of the present disclosure.

To reposition the treadmill 100 from the operating position of FIG. 14 into the storage configuration of FIG. 17, the user may lift the rear end portion 102*b* of the deck assembly 102 to pivot the deck assembly 102 relative to the base frame 104. Referring to FIGS. 14, 16, and 17, the support location 252*a* may remain in a substantially stationary axial position during repositioning of the deck assembly 102 from the operating configuration to the storage configuration. For example, the support location 252*a* may be positioned in the rearward position (see FIG. 14) during movement of the deck assembly 102 between the operating configuration (see FIG. 14) and the storage configuration (see FIG. 17). The link 268 may inhibit axial movement of the support location 252*a* during repositioning of the deck assembly 102 between the operating and storage configurations. By maintaining the support location 252*a* in a substantially stationary position during movement of the deck assembly 102 between the operating and storage configurations, the link 268 may ensure the axial force of the lift assistance mechanism 252 is directed to the deck assembly 102 through the connection 252*b*. The positioning of the support location 252*a* and the amount of force of the lift assistance mechanism 252 may ensure a sufficient lift force is applied to the deck assembly 102 such that the user force required to lift the rear end portion 102*b* of the deck assembly 102 and move the deck assembly 102 from the operating position to the storage position is below a threshold requirement (e.g., 150N at 15 degrees), which may be set by one or more industry organizations. When the deck assembly 102 is in the storage configuration (see FIG. 17), the link 268 may maintain the support location 252*a* in a substantially fixed axially position such that the lift assistance mechanism 252 provides a consistent force to the deck assembly 102 to help maintain the deck assembly 102 in the storage configuration.

Figure 19:
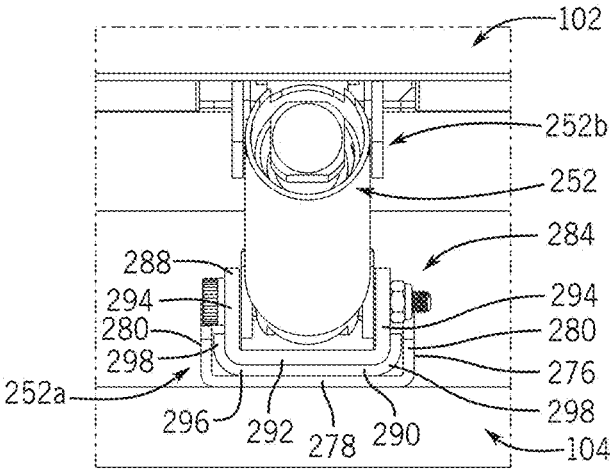
FIG. 19 is an end view of the lift assistance mechanism of FIG. 13 connected to a mount according to one embodiment of the present disclosure.
Figure 20:
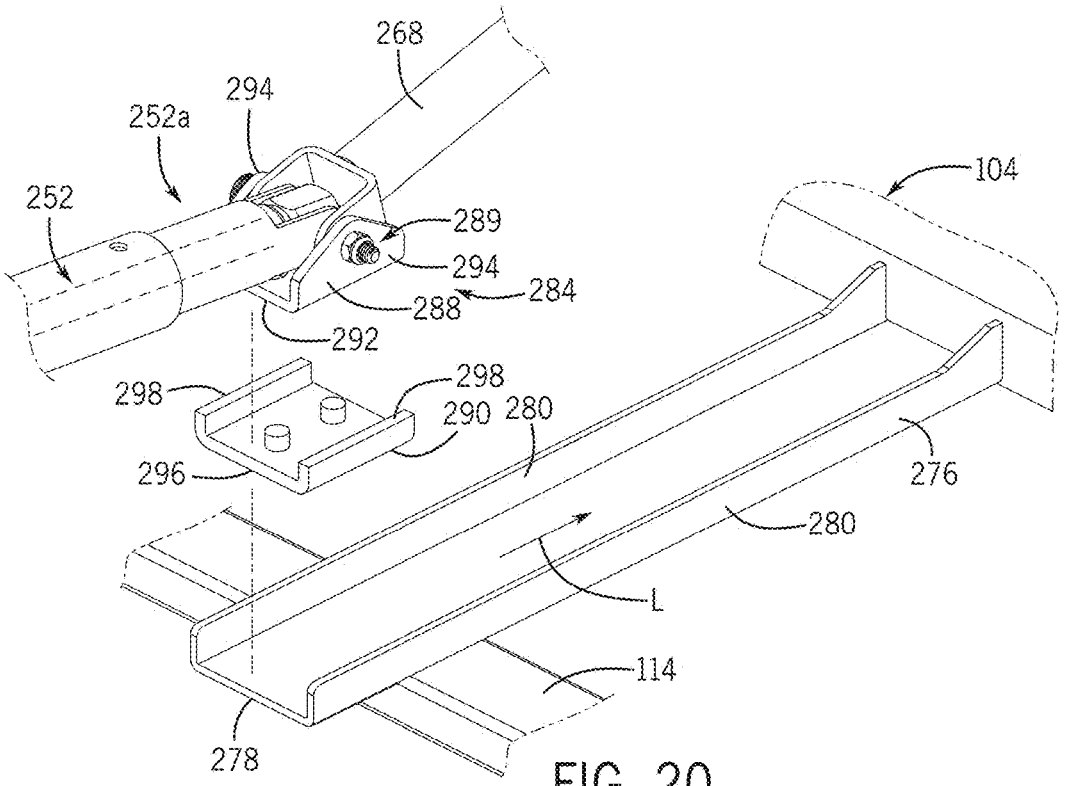
FIG. 20 is a partial exploded view of the mount of FIG. 19 according to one embodiment of the present disclosure.
Figure 21:
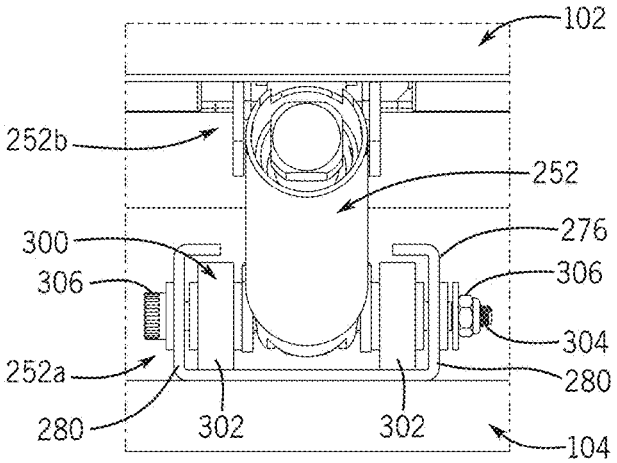
FIG. 21 is an enlarged view of the lift assistance mechanism of FIG. 13 connected to an alternative mount according to one embodiment of the present disclosure.
Figure 22:
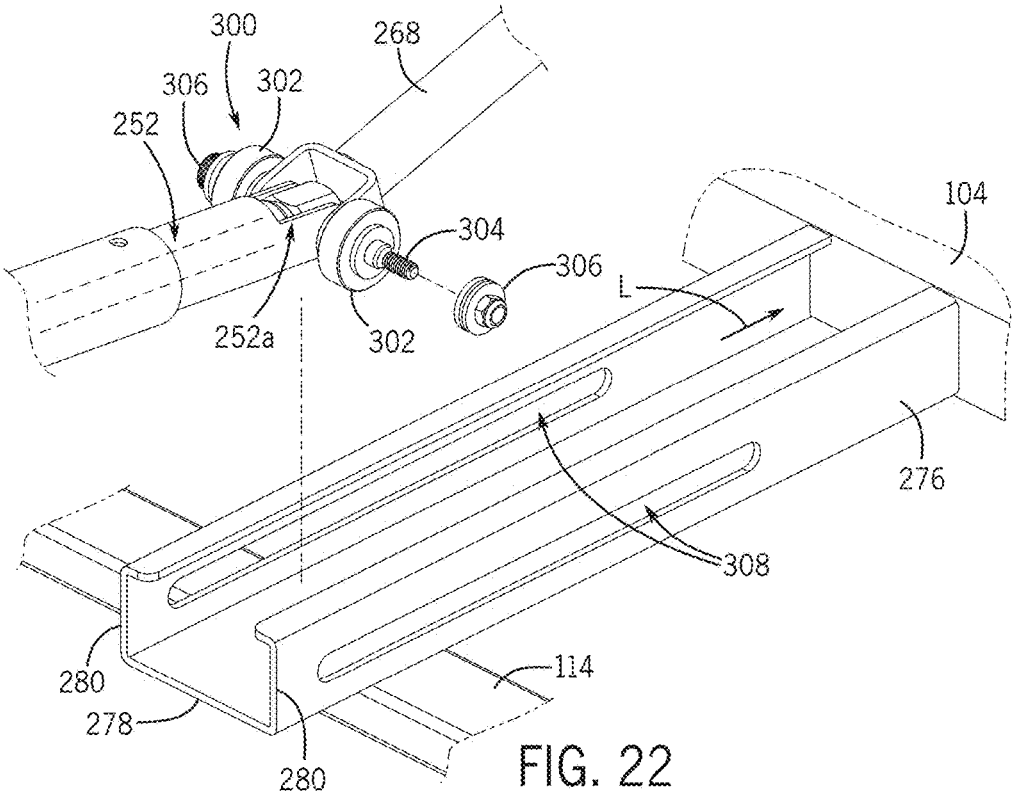
FIG. 22 is a partial exploded view of the mount of FIG. 21 according to one embodiment of the present disclosure.

Referring to FIGS. 18-22, the support location 252*a* may be constrained to move in a substantially straight line along the length L of the treadmill 100. The support location 252*a* may be operatively associated with a track 276 that defines a path for movement of the support location 252*a*. The track 276 may be connected to the base frame 104 and may extend lengthwise along the length L of the treadmill 100. For example, the track 276 may be connected to and extend lengthwise substantially perpendicular to the cross member 114 of the base frame 104. Referring to FIGS. 20 and 22, the track 276 may include a base 278 and walls 280 extending upwardly from the base 278 to define a channel for guiding the support location 252*a* along the length L of the treadmill 100.

Referring to FIGS. 18-22, a mount may be connected to the lift assistance mechanism 252 at the support location 252*a*. The mount may allow pivotal motion of the lift assistance mechanism 252 relative to the track 276 and may be movable along a length of the track 276. The lift assistance mechanism 252 may move the mount forward relative to the base frame 104 when the lift motor 260 raises the front end portion 102*a* of the deck assembly 102, and the link 268 may move the mount rearward relative to the base frame 104 when the lift motor 260 lowers the front end portion 102*a* of the deck assembly 102. The mount may be at least one of rollable or slidable relative to the base frame 104.

Referring to FIGS. 19 and 20, a mount 284 may be slidable along a length of the track 276 relative to the base frame 104. The mount 284 may include a bracket 288 to which the lift assistance mechanism 252 is pivotally connected at the support location 252*a*. The bracket 288 may be constrained by the track 276 to slide in a substantially straight line along the length of the track 276. The bracket 288 may include a base 292 positioned beneath the lift assistance mechanism 252 and walls 294 extending upwardly from the base 292 along opposing sides of the lift assistance mechanism 252. A fastener 289, such as a bolt and nut, may extend through the walls 294 of the bracket 288 to connect the bracket 288 to the lift assistance mechanism 252 at the support location 252*a*. The mount 284 may include a cover 290 attached to a bottom side of the bracket 288 to provide a desired amount of friction between the mount 284 and the track 276. For example, the cover 290 may be formed from a material with a low coefficient of friction (e.g., Polytetrafluoroethylene) to provide a substantially frictionless interface between the mount 284 and the track 276. The cover 290 may include a base 296 and walls 298 extending upwardly from the base 296. The base 296 of the cover 290 may bear against the base 278 of the track 276 and the walls 298 of the cover 290 may bear against the walls 280 of the track 276 during use so as to restrict lateral movement but permit axial movement of the mount 284 relative to the track 276.

Figure 23:
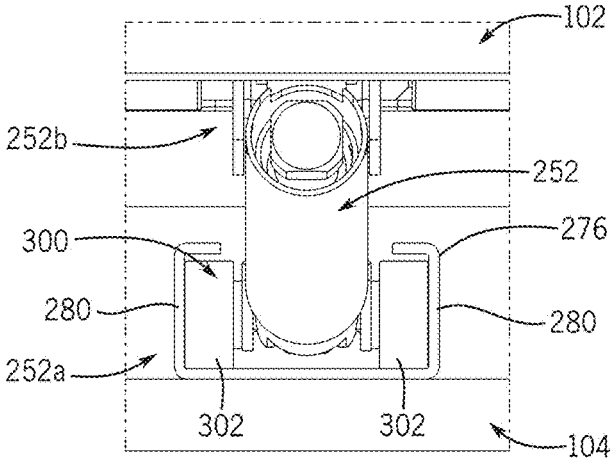
FIG. 23 is an enlarged view of the lift assistance mechanism of FIG. 13 connected to an alternative mount according to one embodiment of the present disclosure.
Figure 24:
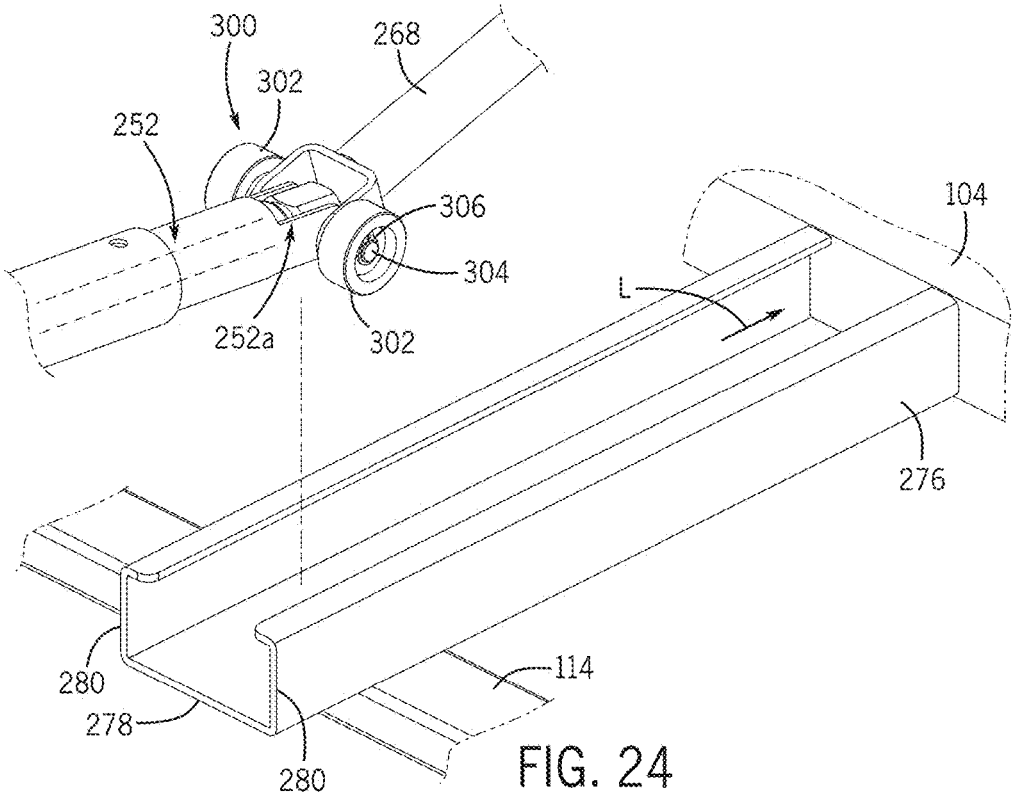
FIG. 24 is a partial exploded view of the mount of FIG. 23 according to one embodiment of the present disclosure.

Referring to FIGS. 21-24, a mount 300 may be rollable along a length of the track 276 relative to the base frame 104. The mount 300 may include one or more rollers 302 rotatably connected to the lift assistance mechanism 252 at the support location 252*a*, and the rollers 302 may be rollable along a length of the track 276. For example, the mount 300 may include first and second rollers 302 positioned on opposite sides of the lift assistance mechanism 252, and the rollers 302 may be connected to the lift assistance mechanism 252 at the support location 252*a* via an axle 304. One or more securement features 306 may secure the rollers 302 to the axle 304. As illustrated in FIGS. 21 and 23, the rollers 302 may be positioned interior of the walls 280 of the track 276. Referring to FIG. 23, the rollers 302 may bear against the walls 280 of the track 276 such that during use the rollers 302 may roll along a length of the base 278 of the track 276 and the walls 280 of the track 276 may inhibit lateral movement of the mount 300 relative to the track 276. Additionally or alternatively, referring to FIG. 21, the axle 304 may extend through the rollers 302 and may be secured to the track 276 via the securement features 306 to restrict lateral movement of the mount 300 relative to the track 276. As shown in FIGS. 21 and 22, the axle 304 may extend through slots 308 formed in the walls 280 of the track 276, and the slots 308 may extend lengthwise along a length of the track 276 to permit axial movement of the mount 300 relative to the track 276 during incline adjustment of the deck assembly 102 of the treadmill 100. As illustrated in FIG. 21, the rollers 302 may be positioned interior of the walls 280, and the securement features 306 may be positioned exterior of the walls 280. During use, the rollers 302 may roll along the base 278 of the track 276 and the axle 304 may move along the slots 308 formed in the walls 280 of the track 276 to permit axial movement of the mount 300 relative to the track 276. The length of the slots 308 may be based on a maximum incline angle of the deck assembly 102. For example, the length of the slots 308 may be longer for treadmills including a larger incline adjustment capability of the deck assembly 102.

In operation, a user may move the deck assembly 102 from a generally horizontal orientation to an inclined orientation while in an operating position (see FIGS. 1 and 13-15). While inclining the deck assembly 102 in the operating position, the support location 252*a* of the lift assistance mechanism 252 may translate forwardly along the length L of the treadmill 100 (see FIGS. 14 and 15 in succession). Once the deck assembly 102 is in the desired incline position, the support location 252*a* may remain in a stationary forward position (see FIG. 15). If an inclined deck assembly 102 is no longer desired, the user may decline the deck assembly 102 from an inclined position (see FIG. 15) to a generally horizontal operating position (see FIG. 14). While declining the deck assembly 102 in the operating position, the support location 252*a* of the lift assistance mechanism 252 may translate rearwardly along the length L of the treadmill 100 (see FIGS. 14 and 15 in reverse order). Once the deck assembly 102 is in the generally horizontal operating position, the support location 252*a* may remain in a stationary rearward position (see FIG. 14). Once the user is finished using the treadmill 100, the user may move the deck assembly 102 to the storage position (see FIG. 17). To move the deck assembly 102 to its storage position, the user may lift the rear end portion 102*b* of the deck assembly 102 (see FIGS. 14, 16, and 17 in succession). While moving the deck assembly 102 to the storage position, the support location 252*a* of the lift assistance mechanism 252 may remain in a substantially stationary position along the length of the treadmill 100 (see FIGS. 14, 16, and 17 in succession).

Referring to FIGS. 13-22, the support location 252*a* of the lift assistance mechanism 252 may be movable relative to the base frame 104 to permit adjustment of the angle of the lift assistance mechanism 252 relative to the angle of the deck assembly 102 during incline adjustment of the deck assembly 102. By allowing the lift assistance mechanism 252 to adjust its angle relative to the deck assembly 102 during incline adjustment of the deck assembly 102, the lift assistance mechanism 252 may at least one of assist a lift motor 260 in inclining the deck assembly 102, reduce the force exerted on the deck assembly 102 by the lift assistance mechanism 252 such that the rear end portion 102*b* of the deck assembly 102 does not lift off the ground during incline adjustment of the deck assembly 102, or supplement a lift force to store the deck assembly 102 such that the user force required to lift the rear end portion 102*b* of the deck assembly 102 to move the deck assembly 102 from the operating position to the storage position is below a threshold requirement (e.g., 150N at 15 degrees), which may be set by one or more industry organizations.

Although various representative embodiments of this invention have been described above with a certain degree of particularity, those skilled in the art could make numerous alterations to the disclosed embodiments without departing from the scope of the subject matter set forth in the specification and claims. For example, a lock mechanism of the present disclosure may be used with various types of treadmills and should not be construed to be limited to function with only the treadmill shown in FIGS. 1 and 2, which is merely exemplary.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "portions" having a particular characteristic and/or being connected with another part. However, those skilled in the art will recognize that the present invention is not limited to components which terminate immediately beyond their points of connection with other parts. Thus, the term "portion" should be interpreted broadly, in a manner that includes areas adjacent, rearward, forward of, or otherwise near the terminus of a particular element, link, component, part, member, or the like. In methodologies directly or indirectly set forth herein, various steps and operations are described in one possible order of operation, but those skilled in the art will recognize that steps and operations may be rearranged, replaced, or eliminated without necessarily departing from the scope of the present invention.

Any one of the above embodiments or processes may be combined with one or more other embodiments and/or processes or be separated and/or performed amongst separate devices or device portions in accordance with the present systems, devices, and methods. The description of exemplary embodiments is intended to be merely illustrative of examples in accordance with the present disclosure and should not be construed as limiting the appended claims to any particular embodiment or group of embodiments. Thus, while examples have been described in particular detail with reference to exemplary embodiments, numerous modifications and alternative embodiments may be devised by those having ordinary skill in the art without departing from the broader and intended scope of the present disclosure as set forth in the claims that follow. Accordingly, the specification and drawings are to be regarded in an illustrative manner and are not intended to limit the scope of the appended claims.

What is claimed is:

1. A treadmill comprising:

a frame;

a deck assembly operably associated with the frame, the deck assembly positionable in an operating position and a storage position;

a variable-length link comprising a lift assistance mechanism, one end of the variable-length link being connected to the deck assembly, and an opposite end of the variable-length link being connected to a support location which is movable along a length of the treadmill relative to the frame;

an incline assembly comprising a support structure pivotally coupled to both the deck assembly and the frame for changing an angle of inclination of the deck assembly relative to the frame; and a connecting link having one end pivotally connected to the support structure and an opposite end pivotally coupled to the variable-length link at the support location.

2. The treadmill of claim 1, wherein the support location is constrained to move in a substantially straight line along the length the treadmill.

3. The treadmill of claim 1, wherein the support location is at least one of rollable or slidable relative to the deck assembly.

4. The treadmill of claim 1, wherein the support location is movable between a first position and a second position along the length of the treadmill when the deck assembly is positioned in the operating position.

5. The treadmill of claim 4, wherein the support location moves from the first position to the second position during inclination of the deck assembly in the operating position.

6. The treadmill of claim 4, wherein the support location is positioned in the first position during movement of the deck assembly between the operating position and the storage position.

7. The treadmill of claim 1, wherein the support location moves along the length of the treadmill during inclination of a front end portion of the deck assembly relative to a rear end portion of the deck assembly.

8. The treadmill of claim 1, further comprising:

a track connected to the frame and extending lengthwise along the length of the treadmill; and a mount connected to the lift assistance mechanism at the support location and movable along a length of the track.

9. The treadmill of claim 8, wherein:

the mount comprises one or more rollers rotatably connected to the lift assistance mechanism at the support location; and the one or more rollers are rollable along the length of the track.

10. The treadmill of claim 9, wherein:

the mount further comprises an axle connected to the lift assistance mechanism at the support location; and the one or more rollers are connected to the axle.

11. The treadmill of claim 9, wherein:

the one or more rollers comprise a first roller and a second roller; and the first and second rollers are positioned on opposite sides of lift assistance mechanism at the support location.

12. The treadmill of claim 8, wherein:

the mount comprises a bracket to which the lift assistance mechanism is pivotally connected at the support location; and the bracket is constrained by the track to slide in a substantially straight line along the length of the track.

13. The treadmill of claim 1, wherein the connecting link has a variable length between its connection to the lift assistance mechanism and the incline assembly.

14. The treadmill of claim 1, wherein the connecting link has a fixed length between its connection to the lift assistance mechanism and the incline assembly.

15. The treadmill of claim 1, wherein the incline assembly comprises a lift motor operatively associated with the support structure to raise a front end portion of the deck assembly relative to a rear end portion of the deck assembly.

16. The treadmill of claim 15, wherein the lift assistance mechanism moves the mount forward relative to the frame when the lift motor raises the front end portion of the deck assembly relative to the rear end portion of the deck assembly to assist the lift motor.

17. The treadmill of claim 1, wherein the lift assistance mechanism comprises a lift cylinder configured to vary the length of the variable-length link.

18. The treadmill of claim 1, wherein the variable-length link comprises a pair of telescoping tubes and wherein the lift assistance mechanism is positioned inside the pair of telescoping tubes.

19. A treadmill comprising:

a frame;

a deck assembly operably associated with the frame, the deck assembly positionable in an operating position and a storage position; and a lift assistance mechanism supported by the frame at a support location and connected to the deck assembly, wherein the support location is movable along a length of the treadmill relative to the frame;

an incline assembly connected to the deck assembly and supported by the frame; and a link pivotally connected to the lift assistance mechanism and the incline assembly, wherein the link has a variable length between its connection to the lift assistance mechanism and the incline assembly.

20. A treadmill comprising:

a frame;

a deck assembly operably associated with the frame, the deck assembly positionable in an operating position and a storage position;

a lift assistance mechanism supported by the frame at a support location and connected to the deck assembly, wherein the support location is movable along a length of the treadmill relative to the frame;

a track connected to the frame and extending lengthwise along the length of the treadmill; and a mount connected to the lift assistance mechanism at the support location and movable along a length of the track, wherein the mount comprises one or more rollers rotatably connected to the lift assistance mechanism at the support location, and wherein the one or more rollers are rollable along the length of the track.

21. The treadmill of claim 20, wherein:

the mount further comprises an axle connected to the lift assistance mechanism at the support location; and the one or more rollers are connected to the axle.

22. The treadmill of claim 20, wherein:

the mount comprises a bracket to which the lift assistance mechanism is pivotally connected at the support location; and the bracket is constrained by the track to slide in a substantially straight line along the length of the track.

* * * * *